US007014976B2

(12) United States Patent
Pickering et al.

(10) Patent No.: US 7,014,976 B2
(45) Date of Patent: Mar. 21, 2006

(54) FUSER MEMBER, APPARATUS AND METHOD FOR ELECTROSTATOGRAPHIC REPRODUCTION

(75) Inventors: Jerry A. Pickering, Hilton, NY (US); Alan R. Priebe, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 137 days.

(21) Appl. No.: 10/634,004

(22) Filed: Aug. 4, 2003

(65) Prior Publication Data

US 2004/0023144 A1 Feb. 5, 2004

Related U.S. Application Data

(60) Provisional application No. 60/400,815, filed on Aug. 2, 2002.

(51) Int. Cl.
*G03G 13/20* (2006.01)

(52) U.S. Cl. ..... 430/124; 399/320; 399/333; 428/447

(58) Field of Classification Search ..... 430/124; 399/320, 333; 428/447
See application file for complete search history.

(56) References Cited

U.S. PATENT DOCUMENTS

| | | | |
|---|---|---|---|
| 3,893,935 | A | 7/1975 | Jadwin et al. |
| 3,967,042 | A | 6/1976 | Laskin et al. |
| 4,011,362 | A | 3/1977 | Stewart |
| 4,029,827 | A | 6/1977 | Imperial et al. |
| 4,046,795 | A | 9/1977 | Martin |
| 4,074,001 | A | 2/1978 | Imai et al. |
| 4,079,014 | A | 3/1978 | Burness et al. |
| 4,101,686 | A | 7/1978 | Strella et al. |
| 4,185,140 | A | 1/1980 | Strella et al. |
| 4,257,699 | A | 3/1981 | Lentz |
| 4,323,634 | A | 4/1982 | Jadwin |
| 4,357,388 | A | 11/1982 | Minor |
| 4,360,566 | A | 11/1982 | Shimizu et al. |
| 4,372,246 | A | 2/1983 | Azar et al. |
| 4,394,430 | A | 7/1983 | Jadwin et al. |
| 4,515,884 | A | 5/1985 | Field et al. |
| 4,518,655 | A | 5/1985 | Henry et al. |
| 4,562,335 | A | 12/1985 | Katsuno et al. |
| 4,603,087 | A | 7/1986 | Ema et al. |
| 4,624,907 | A | 11/1986 | Niimura et al. |
| 4,702,964 | A | 10/1987 | Hirano et al. |
| 4,719,130 | A | 1/1988 | Shimizu et al. |
| 4,780,553 | A | 10/1988 | Suzuki et al. |
| 4,814,250 | A | 3/1989 | Kwarta et al. |
| 4,834,920 | A | 5/1989 | Bugner et al. |

(Continued)

FOREIGN PATENT DOCUMENTS

| | | |
|---|---|---|
| GB | 1 420 839 | 1/1976 |

(Continued)

*Primary Examiner*—Mark A. Chapman
(74) *Attorney, Agent, or Firm*—Carl F. Ruoff

(57) ABSTRACT

Disclosed is a fuser member, including fusing apparatus and electrostatographic methods which employ the fuser member, which has improved wear resistance and a reduced tendency to contaminate with toner particles. The fuser member comprises a core and a pliant coating thereon. The coating comprises a base cushion layer comprised of a first elastomeric composition, with a surface layer thereover comprised of a second elastomeric composition. The hardness of the surface layer is equal to or less than the hardness of the base cushion layer. In embodiments, the surface layer further comprises a particulate silica filler in an amount of about 10 volume percent or less, based on total volume of the surface layer.

53 Claims, 2 Drawing Sheets

U.S. PATENT DOCUMENTS 4,840,864 A 6/1989 Bugner et al.
4,905,050 A 2/1990 Derimiggio et al.
4,971,844 A 11/1990 Schoustra et al.
4,984,027 A 1/1991 Derimiggio et al.
4,987,457 A 1/1991 Mochizuki et al.
5,017,432 A 5/1991 Eddy et al.
5,141,788 A 8/1992 Badesha et al.
5,166,031 A 11/1992 Badesha et al.
5,177,552 A 1/1993 Isogai et al.
5,217,837 A 6/1993 Henry et al.
5,243,393 A 9/1993 Menjo
5,247,336 A 9/1993 Mills, III
5,281,506 A 1/1994 Badesha et al.
5,332,641 A 7/1994 Finn et al.
5,366,772 A 11/1994 Badesha et al.
5,370,931 A 12/1994 Fratangelo et al.
5,480,938 A 1/1996 Badesha et al.
5,530,536 A * 6/1996 Henry et al. ..... 399/333
5,531,813 A 7/1996 Henry et al.
5,601,096 A 2/1997 Lin
5,683,188 A 11/1997 Miyazaki et al.
5,708,067 A 1/1998 Akamatsu et al.
5,778,295 A 7/1998 Chen et al.
5,780,545 A 7/1998 Chen et al.
5,824,416 A 10/1998 Chen et al.
5,846,643 A 12/1998 Badesha et al.
5,918,098 A 6/1999 Van Bennekom
5,935,712 A 8/1999 Tan et al.
5,950,061 A 9/1999 Ota et al.
5,966,578 A 10/1999 Soutome et al.
5,998,033 A 12/1999 Tan et al.
6,011,946 A 1/2000 Eddy et al.
6,037,092 A 3/2000 Heeks et al.
6,099,673 A 8/2000 Van Bennekom
6,114,041 A 9/2000 Tan et al.
6,159,588 A 12/2000 Eddy et al.
6,312,817 B1 * 11/2001 Chen et al. ..... 428/447

FOREIGN PATENT DOCUMENTS

GB 1 501 065 2/1978

* cited by examiner

FUSER MEMBER, APPARATUS AND METHOD FOR ELECTROSTATOGRAPHIC REPRODUCTION

REFERENCE TO PRIOR APPLICATION

This application claims the benefit of U.S. Provisional Application No. 60/400,815, filed Aug. 2, 2002.

FIELD OF THE INVENTION

The present invention relates to electrostatographic imaging and recording apparatus, and particularly to fuser members, apparatus and electrostatographic methods for fixing toner to a receiver.

BACKGROUND OF THE INVENTION

Generally in electrostatographic reproduction, the original to be copied is rendered in the form of a latent electrostatic image on a photosensitive member. This latent image is made visible by the application of electrically charged toner.

The toner thusly forming the image is transferred to a receiver, such as paper or transparent film, and fixed or fused to the receiver. The fusing of toner to receiver can be effected by applying heat, preferably at a temperature of about 90° C.–200° C.; pressure may be employed in conjunction with the heat.

A system or assembly for providing the requisite heat and pressure customarily includes a fuser member and a support, i.e., pressure member. The heat energy employed in the fusing process generally is transmitted to toner on the receiver by the fuser member. Specifically, the fuser member is heated. To transfer heat energy to toner situated on a surface of the receiver, the fuser member contacts the toner, and correspondingly also can contact the surface of the receiver itself. The support member contacts an opposing surface of the receiver. Accordingly, the receiver can be situated between the fuser and support members, so that these members can act together on the receiver to provide the requisite pressure in the fusing process.

During the fusing process, toner can offset from the receiver to the fuser member. Toner transferred to the fuser member in turn may be passed on to other members in the electrostatographic apparatus, or to subsequent receivers subjected to fusing.

Toner on the fusing member therefore can interfere with the operation of the electrostatographic apparatus and with the quality of the ultimate product of the electrostatographic process. This offset toner is accordingly regarded as contamination of the fuser member, and preventing or at least minimizing this contamination is a desirable objective.

U.S. Pat. No. 5,217,837 discloses a toner fusing system which utilizes internal heating with a fuser having a 30–65 micrometer thick fusing surface layer over a 1–3 millimeter thermally conductive HTV silicone elastomer layer. U.S. Pat. Nos. 5,017,432 and 5,332,641 disclose toner fusing systems which use internal heating and fusers with fluoroelastomer fusing surfaces.

Toner fusing systems using external heating are also known. U.S. Pat. Nos. 4,372,246, 4,905,050, 4,984,027, and 5,247,336 all disclose external heating for a toner fusing system. Of these, the latter three teach a configuration with the fuser roller situated between, and in contact with, two external heating rollers.

A factor in achieving sufficient fusing quality is providing sufficient heat transfer from the fusing surface layer of the fuser member to the receiver toner. This heat transfer could be improved by increasing the thermal conductivity of the fusing surface layer of the fuser member, and thermal conductivity can be increased by increasing the amount of heat conducting filler in the fuser member. In general, providing the fusing surface layer with at least a particular minimum amount of the filler is necessary to obtain sufficient thermal conductivity, heat transfer, and fusing quality.

However, heat conducting filler particles in the fusing surface layer provide high energy sites for removing toner from the receiver. Therefore, increasing the amount of heat conducting filler content in the fusing surface layer, by providing more reactive sites for the toner, can increase toner offset and therefore also increase contamination of the fuser member.

It would be desirable to have a fuser roller that improves fuser roller wear resistance while maintaining desirable fusing. It would further be desirable that the fuser roller use external heating and prevent offset from occurring. It would still be further desirable to maintain good paper handling.

SUMMARY OF THE INVENTION

The foregoing advantages may be attained in accordance with the present invention, which in one aspect relates to a fuser member comprising a core and a pliant coating on the core. The coating comprises a base cushion layer comprised of a first elastomeric composition and a surface layer comprised of a second elastomeric composition disposed over the base cushion layer. The hardness of the surface layer is equal to or less than the hardness of the base cushion layer.

In preferred embodiments, the invention further relates to a fuser member comprising a core and a pliant coating on the core. The coating comprises a base cushion layer comprised of a first polyorganosiloxane composition having a durometer hardness at 25° C. of from about 35 to about 80 Shore A and a surface layer comprised of a second polyorganosiloxane composition having a durometer hardness at 25° C. of from about 20 to about 55 Shore A disposed over the base cushion layer. The hardness of the surface layer is equal to or less than the hardness of the base cushion layer and the surface layer further comprises a particulate silica filler in an amount of about 10 volume percent or less, based on total volume of the surface layer.

In other embodiments, the invention relates to a fuser member comprising a core and a pliant coating on the core. The coating comprises a surface layer comprised of a first elastomer and a particulate silica filler in an amount of about 10 volume percent or less, based on total volume of the surface layer. The surface layer has a durometer hardness at 25° C. of from about 20 to about 55 Shore A.

In another aspect, the invention relates to a fusing apparatus for fusing toner images to a receiver medium. The apparatus comprises:

a fuser member comprising a core and a pliant coating on the core, the coating comprising a base cushion layer comprised of a first elastomeric composition and a surface layer comprised of a second elastomeric composition disposed over the base cushion layer, wherein the hardness of the surface layer is equal to or less than the hardness of the base cushion layer;

a pressure member having a contact surface, preferably comprised of an elastomer composition, and positioned adjacent to the fuser member thereby forming a fusing nip there between to receive the receiver medium;

at least one external heater member positioned adjacent to and in contact with the fuser member and external thereto such that heat energy may be transferred to the fuser member by such contact; and a heat source for transferring heat energy to the at least one heater member.

In preferred embodiments, the fusing apparatus comprises:

a fuser member comprising a core and a pliant coating on the core, the coating comprising a base cushion layer comprised of a first polyorganosiloxane composition having a durometer hardness at 25° C. of from about 35 to about 80 Shore A and a surface layer comprised of a second polyorganosiloxane composition having a durometer hardness at 25° C. of from about 20 to about 55 Shore A disposed over the base cushion layer, wherein the hardness of the surface layer is equal to or less than the hardness of the base cushion layer and the surface layer further comprises a particulate silica filler in an amount of about 10 volume percent or less, based on total volume of the surface layer;

a pressure member having a contact surface, preferably comprised of an elastomeric composition, and positioned adjacent to the fuser member thereby forming a fusing nip there between to receive the receiver medium;

at least one external heater member positioned adjacent to and in contact with the fuser member and external thereto such that heat energy may be transferred to the fuser member by such contact; and a heat source for transferring heat energy to the at least one heater member.

In another embodiment, the invention relates to a fusing apparatus for fusing toner images to a receiver medium. The apparatus comprises:

a fuser member comprising a core and a pliant coating on the core, the coating comprising a surface layer comprised of a first elastomer and a particulate silica filler in an amount of about 10 volume percent or less, based on total volume of the surface layer, the surface layer having a durometer hardness at 25° C. of from about 20 to about 55 Shore A;

a pressure member having a contact surface, preferably comprised of an elastomeric composition, and positioned adjacent to the fuser member thereby forming a fusing nip there between to receive the receiver medium;

at least one external heater member positioned adjacent to and in contact with the fuser member and external thereto such that heat energy may be transferred to the fuser member by such contact; and a heat source for transferring heat energy to the at least one heater member.

In still a further aspect, the invention relates to an electrophotographic method for producing fused toner images on a receiver medium. The method comprises the steps of:

forming an electrostatic image pattern on an image forming member;

developing the image pattern on the image forming member with fusible toner particles thereby forming a toner image thereon;

transferring the toner image to the receiver medium;

heating at least one external heater member having a contact surface thereon;

contacting the contact surface of the at least one external heater member with a fuser member comprising a core and a pliant coating on the core, the coating comprising a base cushion layer comprised of a first elastomeric composition and a surface layer comprised of a second elastomeric composition disposed over the base cushion layer, wherein the hardness of the surface layer is equal to or less than the hardness of the base cushion layer, the contact surface of the at least one external heater member being positioned adjacent to and in contact with the surface layer of the fuser member such that a contact nip is formed therebetween and heat is transferred to the fuser member from the at least one external heater member through the contact nip; and feeding the receiver medium bearing the toner image thereon into a fusing nip formed between the surface layer of the fuser member and a contact surface of a pressure member positioned adjacent to and in contact with the fuser member so as to form the fusing nip therebetween, the toner image being fused to the receiver medium by application of heat energy while the receiver medium is passed through the fusing nip.

In preferred embodiments, the method employs a fuser member comprising a core and a pliant coating on the core. The coating can comprise a base cushion layer comprised of a first polyorganosiloxane composition having a durometer hardness at 25° C. of from about 35 to about 80 Shore A and a surface layer comprised of a second polyorganosiloxane composition having a durometer hardness at 25° C. of from about 20 to about 55 Shore A disposed over the base cushion layer. The hardness of the surface layer is equal to or less than the hardness of the base cushion layer and the surface layer further comprises a particulate silica filler in an amount of about 10 volume percent or less, based on total volume of the surface layer.

In another embodiment, the method employs a fuser member comprising a core and a pliant coating on the core. The coating comprises a surface layer comprised of an elastomer and a particulate silica filler in an amount of about 10 volume percent or less, based on total volume of the surface layer. The surface layer also has a durometer hardness at 25° C. of from about 20 to about 55 Shore A.

In embodiments, the fuser member of the present invention is a roller that comprises a cylindrical core and a cushion layer thereover comprising a polyorganosiloxane rubber and having a thickness of 80 to 600 mils.

The cushion, in preferred embodiments, further comprises a surface layer of 3 to 100 mils comprising a polyorganosiloxane rubber of hardness between 20 and 55 Shore A, and a base cushion sub-layer of hardness between about 40 and 75 shore A. The cushion surface layer is equal to or less than the hardness of the cushion sub-layer, and preferably less than the hardness of the sub-layer, although the surface layer and the sub-layer may be the same or essentially the same elastomer material with additives (such as fillers as described herein) included to modify the layer's respective hardness and/or release properties. The cushion (sub-layer and surface layer combined) preferably has an overall composite, i.e., an apparent, hardness of between 40 and 70 Shore A. The surface layer preferably comprises more than 60 volume percent polyorganosiloxane. The polyorganosiloxane is preferably a polydimethylsiloxane. The surface layer also preferably comprises a filler.

The filler used in the surface layer is preferably from about 5 to about 35 volume percent, and more preferably from about 5 to about 30 volume percent, based on total volume of the surface layer. The filler can be one or more metal oxides as described hereinafter. Where silica is present in the surface layer as part of the filler, it is present in an amount which is preferably less than 10 volume percent based on total volume of the layer. The metal oxide preferably has a thermal conductivity of greater than 5 BTU/(hr ft F). At least from about 5 to about 35 volume percent of the layer further preferably comprises a filler with a particle size greater than 8 microns mean particle size (based on number of particles), and more preferably at least from about 5 to about 25 volume percent of the layer comprises a filler with a mean particulate size greater than 12 microns.

The present invention is particularly useful in embodiments for fusing thermoplastic toner where the fuser roller receives at least 50% of the thermal energy for said fusing from a heat source external to the surface of the roller.

The fuser roller further provides good paper handling when the roller comprises either a "crown" shaped profile, i.e., the finished roller has a center portion (the location on the roller which is half the overall length of the roller, as measured from one of its ends) wherein the diameter of the roller is greater than the diameter at the ends of the roller; or a "flare" shaped profile, i.e., the ends of the roller have a diameter which is greater than the diameter at the center portion of the roller. In more preferred embodiments, the difference in diameters at the center portion of the roller and ends of the roller can vary from between about −2 to about +4 mils, as further described hereinafter.

The fuser roller further provides good dimensional stability when used in conjunction with high viscosity release fluids where the viscosity is greater than 1,000 centistokes (cSt). The fuser roller further provides good dimensional stability when the cushion exhibits less than 36% swell in toluene.

By use of a fuser member or fusing apparatus according to the present invention, it has been discovered that fusing quality is maintained even where the quantity of heat conducting filler in the fusing surface layer is reduced, especially when fusing is accomplished using external heat. Accordingly, the present invention has an advantage of allowing for a reduction of the heat conductive filler content of the fusing surface layer, thereby lessening toner contamination, while also improving wear resistance and providing effective fusing of toner to receiver.

It has further been discovered that in a toner fusing system which utilizes external heating as its primary heat source, and which also utilizes a fuser member with one or more base cushion layers and soft fusing surface layer according to the invention, the thickness and durometer hardness of the cushion and fusing surface layer are important to operation of the system. Specifically, these features have been found to be important to minimizing contamination of the surface layer, and also to providing a fuser member with sufficient strength, wearability, and resistance of such layers to delamination.

In this regard, by keeping the fusing surface layer within a particular durometer hardness range and also maintaining the base cushion within a certain durometer hardness range, there is significantly less wear during operation of the system while maintaining a desired fusing nip and paper handling characteristics. Surprisingly, the degree of attachment of the toner to the receiver or other substrate is not affected by the thermal conductivity of the surface layer as a whole, by the amount of heat conducting particles therein, by the identity of these particles, or by the degree of thermal conductivity characterizing the particular type of heat conducting particles employed. Still further, it has been discovered that keeping the overall cushion layer (the base cushion and surface layer) within a particular range for its apparent, i.e., composite, hardness, the advantages of the relatively soft surface layer can be obtained without adversely impacting the performance of the fuser roller.

The apparatus, or system, of the invention includes a fuser member as described hereinabove. The fuser member comprises a fuser base, i.e. core, as well as at least one cushion layer. The cushion layer comprises one or more layers where the outermost region of the cushion is defined as the surface layer. The cushion surface layer may be a separate distinct layer or layers or a part of the cushion layer. The at least one cushion layer overlays or resides on the fuser base.

The cushion surface layer serves to contact toner on the receiver, and can further contact the receiver surface on which the toner resides. The surface layer preferably comprises at least one polyorganosiloxane elastomer, and has a thickness of from about 76 microns, or 0.003 inch, to about 2540 microns, or 0.1 inch.

The apparatus of the invention preferably includes one or more external heater members or other external heat sources, but the fuser member can also be internally heated by any method or device known in the fusing art. It is also possible to combine such external and internal heat sources as described hereinafter. The heater member or members are for heating the fuser base and the layers residing thereon, or at least for heating the fusing surface layer. The heated fusing surface layer in turn heats the toner, thereby providing the necessary heat energy for the fusing process.

The at least one external heater member is preferably the primary heat source for the toner fusing system of the invention. Where at least one internal heat source is also present, it acts as a secondary heat source for the toner fusing system of the invention.

The invention preferably also comprises a support, i.e, pressure, member for co-operating with the fuser member. Specifically, with a receiver located between the fuser member and support member, they co-operate to exert pressure on the receiver during the fusing process. In other words, the fuser and support members define a contact nip that the receiver passes through, thereby providing appropriate pressure for the fusing process.

DETAILED DESCRIPTION OF THE INVENTION

The present invention concerns fuser members, as well as image forming and fusing apparatus and methods for forming toner images using such fuser members, such as by electrophotography or other electrostatographic method.

Figure 1:
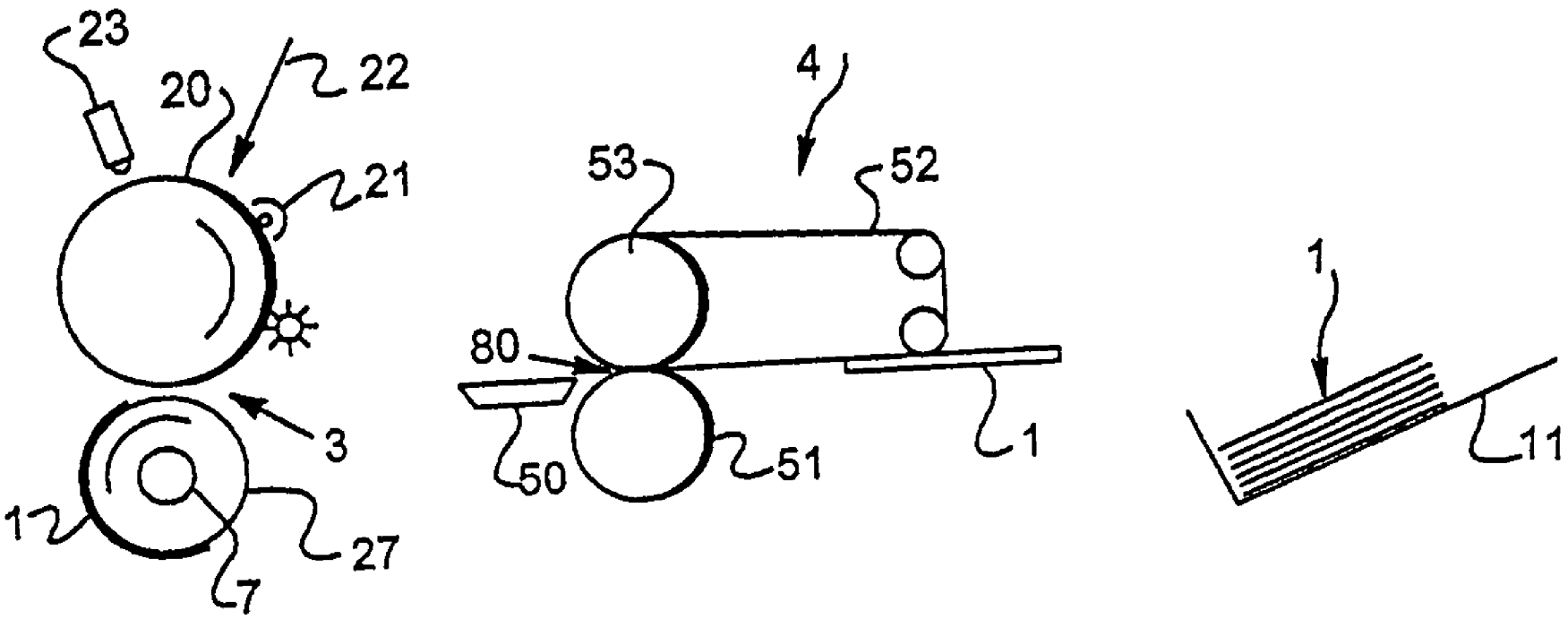
FIG. 1 is a side schematic representation, and sectional view, of an embodiment of an image forming apparatus and method, including a fusing apparatus, in accordance with the present invention.

Referring to FIG. 1 which depicts generally an electrostatographic device, a series of electrostatic images are formed on an image member 20. More specifically, image member 20 is uniformly charged by a charging device 21 and thereafter exposed by an exposing device, such as for example, a laser 22 to create the series of electrostatic images. Each of the images is toned by a toning station 23 to create a series of toner images corresponding to the electrostatic images.

The receiver 1 is attached to the periphery of an image transfer member 27 and rotated through a transfer nip 3 to transfer the electrostatic images on the image member 20 to the receiver 1 to form an image thereon. Transfer can be accomplished by heating transfer member 27 internally with a heat source, for example, a quartz lamp 7 to soften the toner being transferred. Transfer can also be assisted with an electrostatic field.

The receiver 1 bearing the toner image thereon is separated from image transfer member 27 and then fed to further apparatus to be fused to the receiver and otherwise finished as desired. For example, as shown in FIG. 1, the toner image is fused to the receiver by use of a fusing system 4, which receiver bearing the fused toner image is finally deposited in an output tray 11.

Where a belt-type fuser member is employed, fusing apparatus 4 can include an optional preheating device 50 which raises or maintains the temperature of the receiver, a pair of opposed pressure rollers 51 and 53, and an endless fusing belt 52 trained about a series of rollers which includes roller 53. Rollers 51 and 53 are urged together with sufficient force to create substantial pressure in a fusing nip 80 formed between fusing belt 52 and pressure roller 51. At least one of rollers 51 and 53 is generally heated to raise or maintain the temperature of the toner above its glass transition temperature, using for example, quartz lamps (not shown) positioned internally within rollers 51 and/or 53. Alternatively, the rollers can be externally heated by use of external heater rollers, lamps, or other heat sources. The heat and pressure combination within fusing nip 80 causes the toner to soften and bond to the receiver. The receiver bearing the fused toner image thereon continues out of the fusing nip 80 while maintaining contact with belt 52 until the receiver has cooled to a desired temperature, such as below the glass transition temperature of the toner. At this point, receiver 1 is separated from belt 52. Cooling of the toner image before separation can allow for separation without the use of offset-preventing liquids which could degrade the fused toner image.

An example of a fusing apparatus which employs such a belt fuser member is described in U.S. Pat. No. 5,778,295, the teachings of which are incorporated herein by reference in their entirety.

Figure 2:
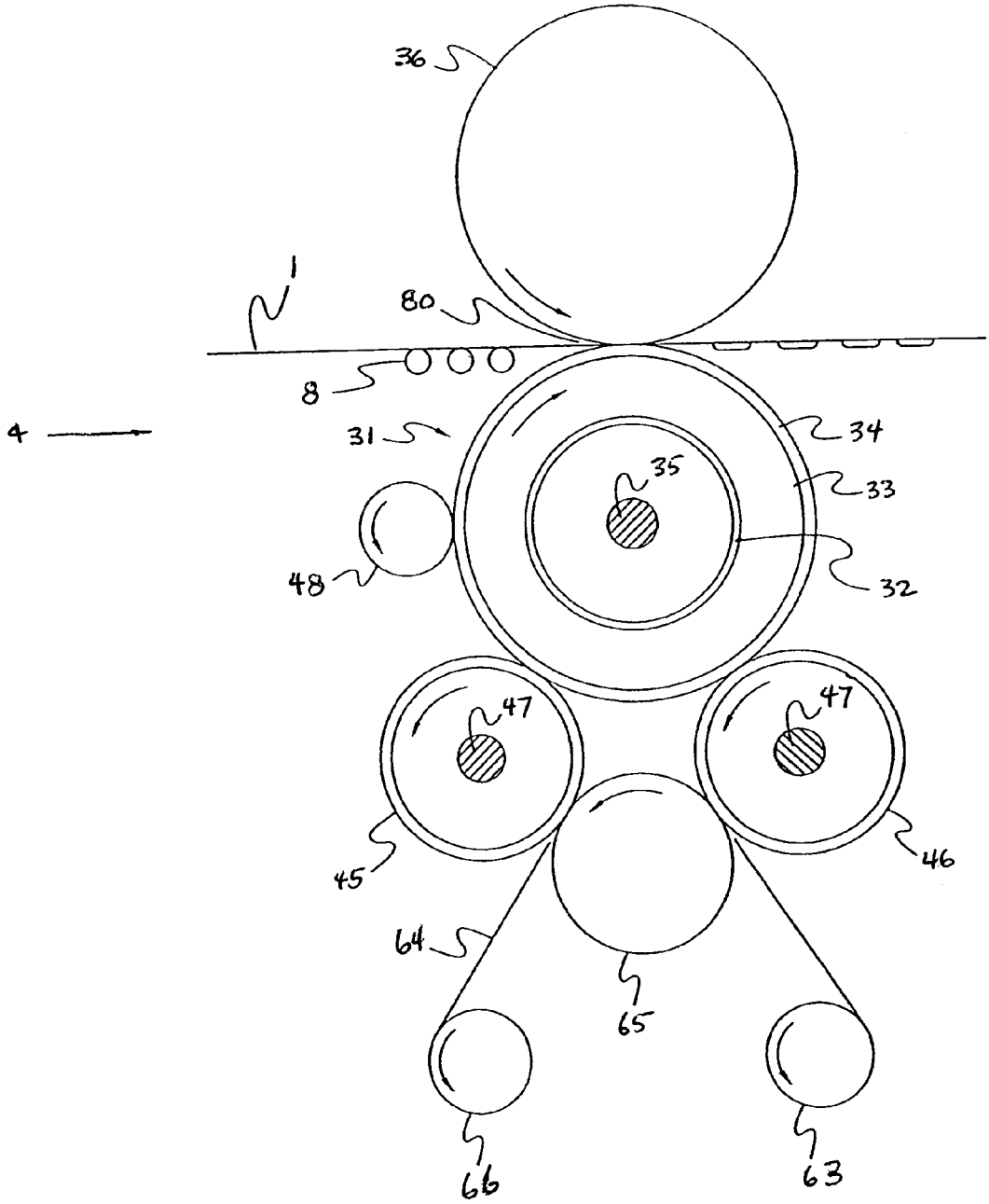
FIG. 2 is a schematic representation, and sectional view, of a further embodiment of a fusing member and apparatus in accordance with the present invention.

An embodiment of a preferred fusing apparatus, which may also be employed in accordance with the invention herein, employs a heated fuser roller with external heater members as shown in FIG. 2. In FIG. 2, a fuser member 31 in roller form comprises, in sequential order, a fuser base, i.e., core 32, in the form of a hollow cylindrical roller, as well as a base cushion layer 33 and a fusing surface layer 34. Internal heat source 35, an optional feature, can be disposed in the hollow portion of fuser base 32.

External heater members 45 and 46 are in the form of hollow cylindrical rollers; with their rotational directions, and the rotational directions of all the other rotating elements, being shown by the respective arrows depicted on FIG. 2. Alternatively, the rotational directions as depicted can be reversed. External heater members 45 and 46 are heated by respective heating lamps 47. These two external heater members are shown spaced apart by a distance less than the diameter of fuser member 31, which is in contact with both. External heater members 45 and 46 transfer heat to fuser member 31 by contact with fusing surface layer 34.

Rotating wick oiler 48 applies a release agent to fusing surface layer 34.

Support member 36, in the form of a backup or pressure roller, cooperates with fuser member 31 to form fusing nip 80. A receiver 1, carrying unfused toner images 8 thereon, passes through fusing nip 80 so that toner images 8 are contacted by fusing surface layer 34. Support member 36 and fuser member 31 act together to apply pressure to receiver 1 and toner images 8, and fuser member 31 also concurrently provides heat, with the heat and pressure both serving to fuse toner 8 to receiver 1.

A cleaning assembly is also advantageously employed to clean toner particles that may adhere to the external heater members during operation of the fuser apparatus. In such an assembly as shown in FIG. 2, a dispensing roller 63 incrementally feeds cleaning web 64 over advance roller 65, to be rolled up onto collecting roller 66. In passing along roller 65, web 64 contacts and cleans contact heating members 45 and 46. Cleaning web 64 can be a polyamide material or its equivalent, such as NOMEX® polyamide commercially available from BMP of America, Medina, N.Y. However, any other suitable cleaning material may be employed. In place of the foregoing cleaning assembly, any other means or apparatus appropriate for cleaning the external heater members may be employed. Alternatively, the external heater members can be provided with a nonstick coating, such as a fluoropolymer material like TEFLON® fluoropolymer commercially available from DuPont of Wilmington, Del., and it can also include a heat conducting filler, also as discussed herein. Where the external heater members have a nonstick coating, a cleaning assembly or its equivalent for cleaning these members can be omitted.

As shown in FIG. 2, the fuser member 31 and, optionally, support member 36 are in general coated with one or more layers of elastomeric materials, such as silicone elastomers, fluoroelastomers, and so-called interpenetrating networks of silicone and fluoroelastomers. Such materials are generally disclosed, for example, in U.S. Pat. Nos. 5,141,788; 5,166,031; 5,281,506; 5,366,772; 5,370,931; 5,480,938; 5,846,643; 5,918,098; 6,037,092; 6,099,673; and 6,159,588, the teachings of which are incorporated herein by reference. Such elastomeric materials are modified, however, such that they have the durometer hardness, filler content, and other aspects as more fully described herein.

The fuser member according to the invention, as described above, is therefore understood as including the fuser base, as well as the base cushion layer and fusing surface layer.

As used herein with reference to heater members or other heat sources, the terms "external" and "internal" pertain to positioning of the heat source with respect to the fuser base. In this regard, "external" indicates a location outside of the fuser base, and "internal" means that the heat source is located within the fuser base. For example, an external heater member is located outside of the fuser member, and therefore outside the fuser base. It thusly provides heat to the fusing surface layer from a location outside of the fuser member. Consistent with the foregoing, an internal heat source is located inside the fuser base, and correspondingly inside the fuser member. It accordingly provides heat to the fusing surface layer from a location within the fuser member.

Further, with respect to the heat source used to heat the fuser member, the term "primary" refers to a heat source which provides more than 50%, and up to and including 100%, of the heat energy needed for fusing toner to the receiver on which it resides. In preferred embodiments, external heating serves as the sole or at least primary source for this heat energy. Correspondingly, the term "secondary" refers to providing less than 50% of the heat energy used for fusing. In the embodiments mentioned above where external heating is the primary heat source, if it is used, an internal heat source serves only as a secondary source for the toner fusing heat energy.

Copolymers are understood as including polymers incorporating two monomeric units, as well as polymers incorporating three or more different monomeric units, e.g., terpolymers, tetrapolymers, etc.

Polyorganosiloxanes are understood as including polydiorganosiloxanes—i.e., having two organo groups attached to each, or substantially each, of the polymer siloxy repeat units. Polyorganosiloxanes are further understood as including polydimethylsiloxanes.

The term "organo" as used herein, such as in the context of polyorganosiloxanes, includes "hydrocarbyl", which includes "aliphatic", "cycloaliphatic", and "aromatic". The hydrocarbyl groups are understood as including the alkyl, alkenyl, alkynl, cycloalkyl, aryl, aralkyl, and alkaryl groups. Further, "hydrocarbyl" is understood as including both non-substituted hydrocarbyl groups, and substituted hydrocarbyl groups, with the latter referring to the hydrocarbyl portion bearing additional substituents, besides the carbon and hydrogen. Preferred organo groups for the polyorganosiloxanes are the alkyl, aryl, and aralkyl groups. Particularly preferred alkyl, aryl, and aralkyl groups are the $C_1$–$C_{18}$ alkyl, aryl, and aralkyl groups, particularly the methyl and phenyl groups.

The fuser base may be a core in the form of a cylinder or a cylindrical roller, such as that illustrated in FIG. 2 herein, and particularly a hollow cylindrical roller. In this embodiment, the fuser base may be made of any suitable metal, such as aluminum, anodized aluminum, steel, nickel, copper, and the like. Also appropriate are ceramic materials and polymeric materials, such as rigid thermoplastics, and thermoset resins with or without fiber enforcement. Preferably the roller is an aluminum tube or a flame sprayed aluminum coated steel tube.

Alternatively, the fuser base may be a plate. Materials suitable for the base in roller form may also be used for the plate form.

One embodiment of a fuser base in a plate form, is a curved plate which is mounted on a larger cylindrical roller—that is, larger than a cylindrical roller which itself is employed as a fuser base. Being thusly curved, the plate accordingly has the shape of a portion of a cylinder. Additionally, the plate can be removably mounted on the cylindrical roller, so that the plate can be replaced without also requiring replacement of the roller. In this embodiment, the properties discussed herein with reference to the fuser base pertain only to the portion of the cylindrical roller occupied by the attached plate; the rest of this roller is not involved in the fusing of toner to receiver.

As yet another alternative, the fuser base may be a belt, particularly an endless flexible belt as illustrated in FIG. 1 above. A thin belt made of a suitable metal, such as those indicated for the base and plate forms; the belt may also be made of a polyimide, particularly a heat resistant polyimide. A polyimide material appropriate for the belt is commercially available under the trademark KAPTON® polyimide from DuPont High Performance Films, Circleville, Ohio.

Preferably the belt is mounted on rollers such as rollers 51 and 53 as shown in FIG. 1, which can be roller cores of the type as discussed herein. As a matter of preference, at least two rollers are utilized with the belt, each of these two rollers defining a curve around which the belt passes.

A support member for the invention can be a backup roller, also referred to as a pressure roller, a plate, or a belt. Cores suitable for the fuser member may also be used for the backup roller. Materials indicated as being appropriate for the fuser base, plate, and belt may also be used for the support roller, plate, and belt.

In any of the indicated forms, the support member may have mounted thereon a cushion for forming the nip with the fuser member. Suitable cushion materials include those having at least some degree of temperature resistance, such as silicone and EPDM elastomers. In the absence of yet a further layer in turn being mounted on the cushion, this cushion also serves to contact the receiver, and accordingly to co-operate with the fuser member.

Alternatively, or in addition to the cushion, the support member may have mounted thereon a thin fluoroplastic surface layer, such as a TEFLON® or PFA fluoropolymer layer, overlying the surface that co-operates with the fuser member. Where a cushion is present on the support member, it is situated between the support member base and the fluoroplastic surface layer.

External heat sources employed in the present invention include external contact heater members—i.e., external heater members that contact the fuser member in transferring heat thereto as shown in FIG. 2 above—as well as non-contact external heat sources. External contact heater members are preferred.

Particularly preferred external contact heater members are cylindrical rollers having disposed therein a suitable heat energy generator, such as a heated wire or a heat lamp. Heating lamps that may be used for this purpose include tungsten filament lamps and halogen quartz lamps. The cylindrical rollers themselves are made of a hard, non-compliant material with high thermal conductivity; one or more suitable metals, such as steel and aluminum, may be employed. Preferably these rollers are aluminum, with anodized aluminum surfaces. The rollers can include one or more polymeric coatings thereon, such as a thermally conductive fluoroplastic or resin, or the polymeric elastomeric materials previously mentioned hereina bove.

Non-contact external heater members include radiant, convection, microwave, and induction heat sources. Heat sources which are appropriate for disposition within contact heater members are likewise suitable for use as a non-contact external heat source. Where a non-contact external heat source comprises a heated wire or a heat lamp, it is situated in sufficient proximity to the fuser member so as to heat the fuser member to a desired level.

Internal heat sources which may be employed in the present invention include heated wires and heat lamps.

Where the fuser base is an endless belt mounted on two rollers in the configuration as discussed herein, there may be a single external heater member situated at one curve of the belt. Alternatively, two external heater members—one at each curve—may be employed.

Where the fuser base is a cylindrical roller, the fuser member correspondingly can be in the form of a roller—specifically, a fuser roller.

In a particularly preferred embodiment of the invention, the fuser base comprises a cylindrical roller and the fuser member correspondingly comprises a fuser roller, with the at least one external heater member comprising two contact heater members, such as the configuration shown in FIG. 2 herein. Three contact heater members can also be used. Each of the contact heater members comprises a cylindrical roller and preferably has a heat source inside. These external heater members are spaced apart by a distance that allows the fuser member to be in contact with both simultaneously. Preferably the support member comprises a backup roller, and forms the indicated fusing nip on the opposite side of the fuser member from the heater member configuration.

The contact heater members can be load bearing—particularly, capable of supporting the load generated by the toner fusing assembly, and more particularly the load that generates the fusing nip between the fuser and support members. With this capability, the heater members form a nest for the fuser member; the fuser member is without support, and is situated in this nest.

Alternatively, the fuser and support members can be supported, and pressed together to form the fusing nip. In this instance, the contact heater members need not be load supporting, but rather are only required to press against the fuser member to effect the requisite heat transfer.

In this embodiment, such as that shown by FIG. 2, the support member is above the fuser member, which itself is above the two contact heater members. In the operation of this embodiment of the toner fusing system, the toner-bearing receiver is fed to the fuser member-support member nip with the toner on the bottom side of the receiver, so as to be contacted by the fuser member.

The positioning of the indicated elements of the fusing apparatus may be reversed, so that the contact heater members are above and the support member below the fuser member. Here the toner-bearing receiver is fed to the nip with the toner on the top side of the receiver.

A cushion overlays the fuser base and comprises a base cushion layer and a fusing surface layer. The base cushion could comprise one or more layers which collectively function as the base cushion layer.

Certain properties of the cushion layer are of particular significance, particularly when external contact heating is employed. For instance, there must be a sufficient area of contact between the fuser member and external contact heater member—i.e., a sufficient portion of the surfaces of the fuser and heater members must be touching—to allow for an effective heat transfer. This contact area is provided by one or both of fuser and heater members having sufficient compliance, or deformability, so that the requisite contact area results from these members being in contact with each other under pressure. Specifically, as between fuser member and contact heater member, at least one of these compresses or indents enough to provide the requisite surface area, i.e., nip, for contact therebetween.

Where the contact heating source is one or more hard, non-compliant external heater members, as discussed, it is the fuser member that has the requisite deformability for achieving the indicated contact area. Moreover, of the elements comprising the fuser member in this embodiment, it is the cushion layer that is sufficiently compliant.

This compliance is determined by a combination of two different features—thickness of the layer and durometer hardness. In order to be compliant enough to provide the necessary contact area, the base cushion layer comprises one or more layers with a total thickness of at least about 1.5 millimeters, more preferably from about 2 millimeters to about 15 millimeters, more preferably about 2.5 to about 13 millimeters and each of these one or more layers preferably has a Shore A durometer hardness at 25° C. of between about 35 to about 80 Shore A, more preferably of between about 40 to about 75, and even more preferably from about 55 to 65.

Considering the foregoing, the cushion layer can include a layer, or multiple layers, that are not equal to or greater than the indicated durometer hardness. For instance, a single cushion layer, or two or more cushion layers, can have an amount of filler, such as heat conducting filler particles, great enough to render a Shore A durometer hardness greater than about 80—or 75, or 70, depending upon what the stated upper limit is; however, the combined layers collectively should have a durometer hardness within the stated range. Each cushion layer which, for this or any other reason, is above the designated hardness upper limit is not included in the indicated total thickness. Conversely, however, any cushion layer is included in the indicated total thickness, if the layer is at or within the designated hardness upper limit.

This particular total thickness—i.e., the sum obtained by adding together the thickness of each cushion layer at or within the stated upper durometer hardness limit—is referred to herein as "compliance total thickness". Where the compliance total thickness is from about 1.5 millimeters to about 3.8 millimeters, each of the layers included in this thickness preferably has a Shore A durometer hardness of about 65 or less. Here, with the relatively low value for the compliance total thickness, a relatively lower hardness is preferred to obtain the requisite compliance.

As a preferred range, the compliance total thickness is from about 2.0 millimeters to about 13 millimeters, with each cushion layer that makes up this thickness having a Shore A durometer hardness of from about 25 to about 70. Regarding this thickness upper limit, presently it is believed that any additional benefit which may be derived from increasing the thickness, such as obtaining greater compliance, diminishes above about 13 millimeters. However, the foregoing observation is provided only for the purposes of discussing the features of the invention as they are currently best understood, and it is not to be considered as a limiting the scope of the invention. Accordingly, compliance total thicknesses of greater than 13 millimeters are also within the scope of the invention.

In contrast with the indicated preferred cushion layer thickness ranges for the present invention, fuser member cushions in toner fusing systems which employ only internal heating are generally not thicker than about 3 millimeters. For these systems, thickness is limited by the excessive fuser base temperatures which would be required for cushions of more than about 3 millimeters, and also is limited because such cushions would entail excessive droop—which is the delay in heating response between the surface of the fusing member and the internal heating source due to the thermal resistance of the cushion. However, in the present invention, even where internal heating is employed, it is secondary to the primary external heating. Accordingly, the greater cushion thickness values of the present invention do not require internal heat source temperatures which would exceed the fuser base limits, nor do they entail excessive droop.

The cushion layer, in preferred embodiments, comprises one or more layers with a total thickness of from about 3.5 millimeters to about 10 millimeters, and each of these one or more layers has a Shore A durometer hardness of about 80 or less—more preferably of about 75 or less, still more preferably of about 70 or less. Still more preferably, the cushion layer comprises one or more layers with a total thickness of from about 3.5 millimeters to about 10 millimeters, and each of these one or more layers has a Shore A durometer hardness of from about 20 to about 80—yet more preferably from about 25 to about 75, and yet more preferably from about 35 to about 70.

The composite of the one or more cushion layers including the base cushion layer and the fusing surface layer comprises an apparent Shore A hardness of between 35 and 75, more preferably between 40 and 75, still more preferably between 40 and 70, and most preferably between 45 and 65. The cushion layer apparent Shore A durometer hardness may be determined in accordance with ASTM D2240, and also modified using plied layers as necessary, all as described in the examples which follow hereinafter. Durometer hardness is also measured at room temperature, i.e., 25° C.

The compliance of the cushion layer provides a contact area when pressed against the support roller. For a fuser roller with a total diameter of about 2.2 inches uniformly loaded against the support roller with about 355 pounds total load, the contact nip length (portion of the circumference of the fuser roller which contacts the support roller) is desirably between about 0.2 and 0.4 inches, and preferably between about 0.22 and 0.38 inches.

The base cushion layer comprises one or more layers. The base cushion layer can include one or more thermally conductive cushion layers and/or one or more thermally nonconductive cushion layers. Where two or more cushion layers are employed, conductive and nonconductive layers can be arranged alternatively, in either order, and/or two or more conductive layers, and/or two or more nonconductive layers, can be positioned sequentially.

The at least one base cushion layer can be free, or substantially free, of heat conducting filler particles. In this regard, there can be provided one or more base cushion layers which are thermally nonconductive by reason of being free, or substantially free, of heat conducting filler particles, or at least being without a sufficient amount of heat conducting filler particles therein to render the layer thermally conductive.

Further, one or more base cushion layers of the invention, particularly those which are thermally conductive, can comprise up to about 45 percent by volume, based on total volume of the layer, of heat conducting filler particles. Compounds suitable as heat conducting filler particles include $SnO_2$, SiC, CuO, ZnO, FeO, $Fe_2O_3$, and $Al_2O_3$. Where heat conductive filler is employed, one or more of these compounds may be used.

Further with respect to heat conductive filler particles, the presence of these in a layer makes the layer harder, i.e., it raises the durometer hardness of the layer. Further, the greater the proportion of this filler in the layer, the harder the filled layer is rendered.

Accordingly, the base cushion layer can comprise heat conducting filler particles dispersed therein, and can be rendered thermally conductive by the presence of a sufficient amount of this filler. Where the fuser member has only one base cushion layer, this layer can comprise heat conducting filler particles dispersed therein, and can be rendered thermally conductive by the presence of a sufficient amount of this filler. Where there is more than one base cushion layer, then one base cushion layer, or more than one layer, up to and including all of the base cushion layers, can comprise heat conducting filler particles dispersed therein, and can be rendered thermally conductive by the presence of a sufficient amount of this filler.

Where there are two or more base cushion layers, then one or more base cushion layers can be free, or substantially free, of heat conducting filler particles, while also one or more of these base cushion layers can comprise heat conducting filler particles dispersed therein, and can be rendered thermally conductive by the presence of a sufficient amount of this filler.

When internal heating is employed along with the primary external heating, the fuser member should include one or more base cushion layers with at least a degree of thermal conductivity. Preferably, there is at least one thermally conductive base cushion layer adjacent to and residing on the fuser base, or at least near the fuser base.

In this regard, thermally conductive layer adjacent to or near the fuser base serves to direct heat from the internal source away from the base, and so help to keep the base or core temperature from becoming excessive. However, when no internal heating is present, then it is preferred that there be no thermally conductive layer adjacent to or even near the fuser base, for the reason that such a configuration would increase the loss of heat energy through the fuser base.

In accordance with the measurement of the cushion layer, the base cushion layer comprises an apparent Shore A durometer hardness of between 35 and 80, more preferably between about 40 and about 70, and still more preferably between about 55 and about 65.

In preparation for application of the cushion layer, the fuser base optionally can first be degreased and surface roughened. If these functions are performed, they may be accomplished by grit blasting. Except as discussed otherwise herein, the fuser base surface, whether or not initially degreased and roughened, is primed with conventional primer, such as Dow™ 1200 RTV Prime Coat primer, from Dow Corning Corporation, Midland, Mich., and material for forming a cushion is subsequently applied thereto.

Elastomeric materials which may be used for the at least one cushion layer most preferably include silicone elastomers, such as thermally conductive silicone elastomers and thermally nonconductive silicone elastomers. Addition cure, condensation cure, and peroxide cure silicone elastomers can all be used, with addition cure silicone elastomers and condensation cure silicone elastomers being preferred.

Further, silicone elastomers formulated as room temperature vulcanizate (RTV), liquid injection moldable (LIM), and high temperature vulcanizate (HTV) silicone elastomers can be used. RTV and LIM silicones are preferred.

Another desirable property is resistance to swell from silicone fluids, particularly polydimethylsiloxane fluids. This may be accomplished using a high crosslink density in the siloxane, using inorganic or otherwise non-swelling filler particles, or a combination of both. A preferred silicone for the at least one cushion has a dimensional swell of less than 5 percent, preferably less than 4 percent, still more preferably less than 3 percent in the release fluid used in conjunction with the present invention.

To form a cushion layer, the silicone elastomer is molded, particularly by injection, or extruded or cast onto the fuser base to the desired thickness. Curing is then effected. For a RTV silicone, this is accomplished by allowing it to sit at room temperature.

After curing, the silicone layer is subjected to a post cure step which improves compression set resistance. Typically a post cure step is conducted at a temperature of around about 200 to about 240° C. for at least about 1 hour.

Each silicone cushion layer is subjected to cure, and preferably also to post cure, before application of the next layer. The cushion layer may also be subjected to a surface treatment such as a plasma, flame, or corona discharge prior to the subsequent layer, or by application of a suitable primer or adhesion layer.

Addition cure silicone elastomers typically employ a platinum catalyst; condensation cure silicone elastomers, a tin catalyst. Tin catalysts will poison platinum catalysts, but the reverse is not true. Accordingly, where sequential addition and condensation cure silicone elastomer layers are employed, a condensation cure layer can be applied onto an addition cure layer, but the reverse is not desired due to poisoning of a platinum catalyst.

The cushion has a fusing surface layer. The fusing surface layer is the outermost layer that contacts the toner. Incidental or transient layers such as a coating or molding skin, or release oil layers are not considered the fusing surface layer as they are worn away rapidly relative to the life of the fuser member.

The elastomeric polyorganosiloxanes useful for the base cushion may also be used for the fusing surface layer, including the RTV, HTV and LIM materials. While both condensation and addition curable silicone may be employed, condensation curable silicones are preferred.

The fusing surface layer provides the necessary heat to fuse the toner image onto the receiver, provides for release of the fused toner, imparts a surface character onto the toner image, and is subject to wear by contact with a receiver medium. It has been found that a particular range of durometer hardness improves the wear resistance of the fuser surface layer. Surprisingly, this resistance to wear is obtained across a variety of silicone formulations of varying filler types.

One reason for the presence of heat conducting filler in the fusing surface layer pertains to the external heater member or members, particularly where contact heating is employed. Specifically, the fusing surface layer can incorporate heat conducting filler particles for the purpose of lowering the temperature to which contact heater members must be raised in order to transfer the necessary heat to the fusing surface layer.

The issue here is how hot the contact heater member or members must get so as to apply sufficient heat to the fuser member. The fusing surface layer may have heat conducting filler particles dispersed therein, to lower this temperature requirement. Thus, contact heater members, particularly in the case of cylindrical rollers, can be comprised of materials, especially certain metals, which otherwise would not be suitable because of the temperature to which they would have to be raised in the absence of the heat conducting filler.

Alternatively, it is possible to employ, for the contact heater member or members, metals which would not be adversely affected by the higher temperatures required where heat conducting filler is absent. Where such an appropriate metal or metals is used, it is not necessary to include heat conducting filler in the fusing surface layer for the indicated purpose of lowering the contact heater member temperature requirement.

In accordance with the first requirement it has been thought that the surface requires an increased thermal conductivity to provide good fusing of the toner. However, surprisingly it has been found that for a fuser that is externally heated, the fusing does not suffer as the thermal conductivity is lowered, provided the fuser cushion maintains the durometer hardness range previously specified.

The fusing surface layer comprises a polyorganosiloxane elastomer with a durometer hardness of between 20 and 55 Shore A (equivalent to $0.66\times10^6$ pascals to $3.0\times10^6$ pascals in tensile modulus for a polyorganosiloxane when conducting dynamic mechanical analysis at fusing temperature), preferably of between 25 and 50 Shore A ($0.81\times10^6$ pascals to $2.3\times10^6$ pascals in tensile modulus as per above), more preferably of between 30 and 50 Shore A ($1\times10^6$ pascals to $2.3\times10^6$ pascals in tensile modulus as per the above). The fusing surface layer preferably has a durometer hardness that is at least equal to or less than the apparent Shore A hardness of the base cushion layer, and more preferably less than the Shore A durometer hardness of the base cushion layer. This helps to avoid splitting or cracking of the fusing surface layer and delamination. The conformability of the fusing surface layer also helps to minimize toner contamination provided the layer is not too soft. If the fusing surface is below about 20 Shore A, the toner release is generally degraded. In addition, other properties such as oil swell are likely to be poor.

To reduce the amount of toner offset, the fusing surface layer preferably comprises polyorganosiloxane where the volume percent of polyorganosiloxane is between 65% and 90%, more preferably between 70% and 85%, still more preferably between 70 and 80% by volume, based on the total volume of the layer.

As a matter of preference, silica is minimized in the fusing surface layer. Silica is often employed in polyorganosiloxanes as a filler for reinforcement; however, it is not desirable in the fusing surface layer. While not entirely understood, and without wishing to be bound thereby, silica is believed to contribute toward increased toner contamination when used in the fusing surface layer, thusly silica including fumed, precipitated, natural, or synthetic is minimized in the present invention. More specifically, the volume percent of silica is preferred to be less than 10 volume percent of the fusing surface layer, more preferably less than 5 volume percent, still more preferably less than 2 volume percent of the fusing surface layer.

With respect to wear resistance, one or more types of the filler can be incorporated into the fusing surface layer in such amount or amounts as will increase this layer's durability. For improving the wear resistance, one or more of any fillers which are employed may be utilized or surface treated with a coupling agent as discussed in U.S. Pat. Nos. 5,998,033, 5,935,712, and 6,114,041. These patents are incorporated herein in their entireties, by reference thereto.

When fillers are employed they are preferably metal oxides. The same compounds suitable as heat conducting filler particles for the at least one base cushion layer may also be used for the fusing surface layer. The fusing surface layer can comprise, dispersed therein, preferably up to about 35 percent by volume, more preferably up to about 32 percent by volume, even more preferably from about 10 percent by volume to about 32 percent by volume, and most preferably from about 12 to about 28 percent by volume, of heat conducting filler particles based on total volume of the surface layer.

The metal oxides preferably have a thermal conductivity of greater than about 5 btu/(hr ft F).

The different types of fillers incorporated in the base cushion and fusing surface layers of the invention may be in one or more of any suitable shapes—irregular, as well as in the form of spheroids, platelets, flakes, ovoids, and the like. In the case of heat conducting fillers, an irregular shape is more preferred, as are spherical particles and platelets. However, fibers, needles, and otherwise elongated shapes with an aspect ratio greater than 5 are less preferred.

As is also the case with other fillers, the fusing surface layer can be free, or substantially free, of heat conducting filler particles. In this regard, the fusing surface layer can receive and transfer the requisite heat for effecting fusing of toner to receiver, without requiring the presence of the heat conducting filler.

Moreover, also depending on filler identity and proportion, roughness of the surface can be increased or lessened, as desired, by the presence of the filler. Fillers used in the present invention preferably have a mean particle diameter of about 0.1 microns to about 80 microns, more preferably about 0.2 microns to about 20 microns.

To provide reduced wear, the filler particles preferably comprise a portion of large particles. These large particles also provide a reduced gloss on the toner surface. To achieve a reduced wear rate there are preferably at least 15 to 35 volume percent of particles that are larger than 8 microns, least 10 to 25 volume percent are larger than 12 microns, or 5 to 15 volume percent are larger than 20 microns.

Insufficient thickness of the fusing surface layer results in problems with respect to wearability. Wear is caused by the receiver media edges as well as scrubbing of the fusing surface layer by the receiver. Media edge wear is a particular problem when employing a variety of media sizes in that an edge of a smaller sized media imparts a surface defect or groove that may be visible within the imprinted regions of the larger media which overlays the created wear defect.

Edge wear defects are usually not visible until the depth of the defect reaches about 3 to 8 mils in depth. If the fusing surface layer is thinner than this depth, then the underlying base cushion will be exposed and subjected to potential early failure. Accordingly the same early failure may result if the media scrubbing by the media surface penetrates the fusing surface layer.

Thusly, the fusing surface layer desirably has a thickness of at least about 50 microns. Preferably the fusing surface layer has a thickness of at least about 75 microns, and more preferably at least about 100 microns.

In a preferred embodiment, the fusing surface layer has a thickness of between about 75 microns and about 2500 microns. In another preferred embodiment the fusing surface layer has a thickness of between about 75 microns and about 2500 microns, and the base cushion has a thickness of between about 1000 and 15000 microns. In a more preferred embodiment the fusing surface layer has a thickness of between about 75 microns and about 2000 microns, and the base cushion has a thickness of between about 2000 and 10000 microns. In a yet still more preferred embodiment the fusing surface layer has a thickness of between about 75 microns and about 1300 microns, and the base cushion has a thickness of between about 2200 and 7000 microns.

The cushion material can be ground to a desired profile, depending upon the paper handling concerns to be addressed. For instance, a cylinder shape, or a crown, or barrel, or bow tie, or hourglass profile may be provided. Straight or larger diameter at the media edges is preferred to prevent wrinkling. If the diameter at the edges is too much larger than the center, then either buckling of the media or poor contact at the center will result.

The fuser minimum outer diameter between the center and 2 inches from the center subtracted from the maximum diameter between 3 inches from the center and 5 inches from the center is preferably between +100 and −50 microns, more preferably between +75 and −25 microns.

In one particular embodiment of the invention, the fuser member has a single silicone elastomer cushion layer, with a thickness of from about 200 mils (about 5 millimeters) to about 400 mils (about 10 millimeters), comprising an about 40 Shore A silicone rubber. This cushion layer does not have heat conducting filler added thereto, and is a thermally nonconductive or low thermal conductivity material; preferably with less than about 10 volume percent silica, based on total volume of the layer.

In another particular embodiment of the invention, the fuser member has two silicone elastomer cushion layers, one overlying the other, with a total cushion thickness also of from about 200 mils (about 5 millimeters) to about 400 mils (about 10 millimeters). Like the single cushion layer of the immediately preceding embodiment, the underlying (base cushion) layer in this embodiment does not have heat conducting filler added thereto, and is a thermally nonconductive or low thermal conductivity material; it also preferably comprises Silastic-J silicone as described in the examples which follow. The overlying fusing surface layer contains a thermally conductive material, preferably highly thermally conductive, and also preferably a filler content of from about 25 to about 32 volume percent; yet further as a matter of preference, this layer comprises a condensation curable silicone containing less than 2 percent silica and has a durometer hardness at 25° C. of between about 40 and 45 Shore A. Of the indicated total cushion thickness, the base cushion layer underneath is relatively thicker, and the overlying surface layer is relatively thinner. In this regard, the surface layer has a thickness of from about 15 to about 30 mils (from about 0.38 to about 0.76 millimeters), with the underlayer accounting for the remainder.

In the operation of the toner fusing system of the present invention, release agent can be applied to the fusing surface layer so that this agent contacts toner on the receiver, and can also contact the receiver, during the operation of the fuser member. Particularly where the fuser base is a cylindrical roller or an endless belt, the release agent is applied, while the base is rotating or the belt is running, upstream of the contact area between fuser member and receiver toner.

If employed, release agent preferably is applied so as to form a film on the fusing surface layer. As a matter of particular preference, release agent is applied so as to form a film that completely, or at least essentially, or at least substantially, covers the fusing surface layer. Also as a matter of preference, during operation of the system the release agent is applied continuously, or at least essentially or at least substantially continuously, to the fusing surface layer.

Release agents are intended to prohibit, or at least lessen, offset of toner from the receiver to the fusing surface layer, and if release agent is employed preferably it acts accordingly. In performing this function, the release agent can form, or participate in the formation of, a barrier or film that releases the toner. Thereby the toner is inhibited in its contacting of, or at least prevented from adhering to, the fusing surface layer.

The release agent can be a fluid, such as an oil or a liquid, and is preferably an oil. It can be a solid or a liquid at ambient temperature, and a fluid at operating temperatures. Also as a matter of preference, the release agent is a polymeric release agent, and as a matter of particular preference, is a silicone or polyorganosiloxane oil.

Suitable release agents are those disclosed in U.S. Pat. Nos. 5,824,416, 4,515,884, and 5,780,545. These three patents are incorporated herein in their entireties, by reference thereto.

The release agent is preferred to cause minimal swell of the elastomer layers of the fuser member. As a matter of preference the silicone has a viscosity greater than about 5,000 cSt at ambient temperature, preferably greater than about 9000 cSt, still more preferably between about 10,000 and 100,000 cSt viscosity, and yet still more preferably between about 20,000 and about 100,000 cSt viscosity at ambient temperature.

Further, release agents which may be used include polymeric release agents having functional groups. Appropriate polymeric release agents with functional groups include those which may be found as liquids or solids at room temperature, but are fluid at operating temperatures.

Particular functional group polymeric release agents which may be used include those disclosed in U.S. Pat. Nos. 4,011,362 and 4,046,795; these patents also are incorporated herein in their entireties, by reference thereto. Still further release agents which may be used are the mercapto functional polyorganosiloxanes disclosed in U.S. Pat. No. 4,029,827, and the polymeric release agents having functional groups such as carboxy, hydroxy, epoxy, amino, isocyanate, thioether, and mercapto functional groups, as disclosed in U.S. Pat. Nos. 4,101,686 and 4,185,140; yet additionally these patents are incorporated herein in their entireties, by reference thereto.

The more preferred release agents with functional groups are the mercapto functional polyorganosiloxane release agents and the amino functional polyorganosiloxane release agents. Particularly preferred are the release agents, including mecapto functional polyorganosiloxane release agents comprising monomercapto-functional polyorganosiloxanes, or polyorganosiloxanes having one mercapto functional group per molecule or polymer chain. Also particularly preferred are release agents, including amino-functional polyorganosiloxane release agents comprising monoamino-functional polyorganosiloxanes, or polyorganosiloxanes having one amino functional group per molecule or polymer chain. In this regard, the release agents disclosed in U.S. Pat. Nos. 5,531,813 and 6,011,946 may be used; these patents are incorporated herein in their entireties, by reference thereto.

Further with regard to the functional agents, one point to consider is that because of their expense usually they are diluted with nonfunctional polyorganosiloxanes, particularly nonfunctional polydimethylsiloxanes. Another point is that for obtaining good release activity with a functional release agent, monofunctionality is preferred, so that the molecule cannot react both with toner and with the fusing surface layer, and thereby serve as a toner/fuser member adhesive. Therefore, the functional agent would ideally comprise a substantial portion of the mono-functional molecule.

Therefore, the functional polyorganosiloxane preferably comprises as great a proportion of the monofunctional moiety as is practically possible. As a matter of particular preference, the functional polyorganosiloxane has a sufficient monofunctional proportion so as not to act as the indicated adhesive.

Accordingly, a preferred release agent composition comprises a blend of nonfunctional polyorganosiloxane, particularly nonfunctional polydimethylsiloxane, with amino functional polyorganosiloxane, and the amino functional polyorganosiloxane comprises monoamino functional polyorganosiloxane. Another preferred release agent composition comprises a blend of nonfunctional polyorganosiloxane, particularly nonfunctional polydimethylsiloxane, with mercapto functional polyorganosiloxane, and the mercapto functional polyorganosiloxane comprises monomercapto functional polyorganosiloxane.

The release agent may be applied to the fuser member by any suitable applicator, including sump and delivery roller, jet sprayer, oiled pad, etc. Those means as disclosed in U.S. Pat. Nos. 5,017,432 and 4,257,699 may be employed; the latter of these two patents is incorporated herein in its entirety, by reference thereto. Preferably the present invention employs a rotating wick oiler.

A wick oiler comprises a storage compartment for the release agent and a wick in contact with this compartment. During operation of the toner fusing system of the invention, the wick is situated so as to be in contact with the stored release agent and also with the fusing surface layer of the fuser member; the wick thusly picks up release agent and transfers it to the fuser member. A rotating wick oiler further rotates in conjunction with the fuser surface and does not slide against the surface. In this manner streaks in the applied oil layer and/or abrasion of the fuser surface layer are avoided.

The release agent is applied to the receiver, particularly in the case of paper, preferably at a rate of from about 0.1 to about 20 microliters, more preferably at a rate of about 1.0 to about 8 microliters, per 8½" by 11" copy. The applicator accordingly is adjusted to apply the release agent at this rate.

SPECIFIC EMBODIMENTS OF THE INVENTION

The invention is illustrated by the following examples, which are provided for purposes of representation, and are not to be construed as limiting the scope of the invention. Unless stated otherwise, all percentages and parts are by weight and temperatures are in degrees Celsius (° C.).

Materials

The following materials are used:

$Al_2O_3$ powders (Al600, Al601, AL602 Al604) available from Atlantic Equipment Engineers of Bergenfield, N.J.

Dow™ 1200 RTV Prime Coat primer, from Dow Corning Corporation which is a metal alkoxide type primer containing light aliphatic petroleum naptha (85 weight percent), tetra(2-methoxy-ethoxy)-silane (5 weight percent), tetrapropyl orthosilicate (5 weight percent), and tetrabutyl titanate (5 weight percent).

Silastic™-J addition cure RTV silicone rubber, from Dow Corning Corporation.

Stycast™ 4952, also known as EC4952 and LS4340-103 condensation cure RTV silicone rubber, from Emerson & Cuming, Inc.

A 60,000 centistoke DC200 polydimethylsiloxane oil, available from Dow Corning Corporation.

Catalyst 50, from Emerson & Cuming, Inc.

COMPARATIVE EXAMPLE A

Comparative Example A is prepared by combining 212 parts of AL602 (alumina powder) per 100 parts of a polydimethylsiloxane (LS4340-103) by hand mixing and then compounding them with a three roll mill into a uniform mixture of material. The mixture is then combined with 0.25 parts of Catalyst 50 per 100 parts of mixture before degassing the resulting mixture, then such mixture is injection molded into a mold cavity and cured in a convection oven at 60° C. for 24 hours to obtain a slab of cured material measuring 0.25 in×3 in×5 in. After demolding, the resulting slabs are post cured for 4 hours at 205° C. after a 2 hour ramp from room temperature. A 0.59 inch wide strip is cut from the slab for surface abrasion testing.

The slab has a 38.5 volume percent total filler content (primarily silica, iron oxide, and alumina), with 36.2 volume percent of the slab being alumina, both being based on the total volume of the slab, which volume percentages are listed in Table I hereinafter for comparison purposes. The alumina powder employed has a mean particle diameter of 24.7 $\mu$m and particle size distribution also as shown in Table I hereinafter, both based on the number of particles, which are determined with a Horiba LA-920 particle size analyzer available form Horiba Laboratory Products of Irvine, Calif.

Surface abrasion testing is performed using a Norman abrader apparatus (Norman Tool, Inc. of Evansville, Ind.) that uses a 0.69 inch wide strip of paper pressed in contact with the rubber sample slab and dragged under a load in a cyclic manner to produce abrasive wear. The sample temperature is maintained at 175° C. during the test. The depth of the resulting sample wear track is measured using a Surfanalyzer 4000 instrument obtained from Mahr Federal of Providence, R.I. which is equipped with a conical stylus under a 250 mg load, and the result is divided by the number of cycles in decades. The result obtained is a wear rate in terms of mils per 100 cycles, and is shown in Table I.

Durometer hardness of the resulting slab is determined substantially according to ASTM test method D2240, except as provided otherwise hereinafter. A durometer hardness gauge calibrated for Shore A is mounted on a test stand with a 1 kg total loading force on the indenting tip. The slab samples (0.250" thick) are placed on a flat surface and hardness is measured by taking the maximum reading from the dial within 1 sec after the force is applied and the gauge comes into contact with the sample. Hardness readings are taken from five (5) areas of the test slab, and the mean is calculated from such readings for each sample. The Shore A hardness reported is the mean value taken from the readings, and it is measured at room temperature, i.e., 25° C.

COMPARATIVE EXAMPLE B

The procedure of Comparative Example A is substantially repeated, except as provided otherwise hereinafter. A mixture is initially formed by combining 203 parts of alumina powder (AL601) per 100 parts of the polydimethylsiloxane (LS4340-103) by hand mixing and compounding them in the three roll mill. The mixture is combined with 0.25 parts of Catalyst 50 per 100 parts of mixture before degassing, then the resulting mixture is injection molded and cured to obtain a slab. The slab is post cured, sampled, and tested substantially as described in Comparative Example A. The data for the slab prepared according to Comparative Example B is shown in Table I.

COMPARATIVE EXAMPLE C

The procedure of Comparative Example A is substantially repeated, except as provided otherwise hereinafter. A mixture is initially formed by combining 223 parts of alumina powder (AL604) per 100 parts of the polydimethylsiloxane (LS4340-103) by hand mixing and compounding in the three roll mill. The mixture is combined with 0.25 parts of Catalyst 50 per 100 parts of mixture before degassing, then the resulting mixture is injection molded and cured substantially as described in Comparative Example A to obtain a slab. The slab is post cured, sampled and tested substantially as described in Comparative Example A. The data for the slab prepared according to Comparative Example C is shown in Table I.

COMPARATIVE EXAMPLE D

The procedure of Comparative Example A is substantially repeated, except as provided otherwise hereinafter. A mixture is initially formed by combining 201 parts of alumina powder (AL600) per 100 parts of the polydimethylsiloxane (LS4340-103) by hand mixing and compounding in the three roll mill. The mixture is combined with 0.25 parts of Catalyst 50 per 100 parts of mixture before degassing, then the resulting mixture is molded and cured substantially as in Comparative Example A to obtain a slab. After demolding, the slab is post cured, sampled, and tested substantially as described in Comparative Example A. The data for the slab prepared according to Comparative Example D is shown in Table I.

EXAMPLE 1

Example 1 is prepared by substantially repeating the procedure of Comparative Example A, except as provided otherwise hereinafter. Initially, a mixture is formed by combining 78.9 parts of polydimethylsiloxane (LS4340-103) per 100 parts of the mixture obtained by Comparative Example A (the polydimethylsiloxane and AL602 alumina powder mixture) prior to adding Cat 50 catalyst. Cat 50 is then added at 0.45 parts per 100 parts of the mixture, and then the mixture is degassed, injection molded, and cured substantially as in Comparative Example A to obtain a slab. The slab is post cured, sampled, and tested substantially as described in Comparative Example A, with the data being given in Table I for comparison purposes. Relative to Comparative Example A, the resulting slab has a reduced amount of filler in terms of volume percent, with a corresponding reduction in durometer hardness.

EXAMPLE 2

Example 2 is prepared by substantially repeating the procedure of Example 1, except as provided otherwise hereinafter. Initially, a mixture is formed by combining 27.6 parts of polydimethylsiloxane (LS4340-103) per 100 parts of the mixture obtained by Comparative Example B (polydimethylsiloxane and AL601 alumina powder mixture) prior to adding Cat 50 catalyst. Cat 50 is then added at 0.36 parts per 100 parts of the mixture before degassing, injection molding, and curing the mixture substantially as described in Comparative Example A to obtain a slab. The slab is post cured, sampled, and tested substantially as described in Comparative Example A, with the data being given in Table I for comparison purposes. Relative to Comparative Example B, the resulting slab has a reduced amount of filler in terms of volume percent, with a corresponding reduction in durometer hardness.

EXAMPLE 3

The procedure of Comparative Example A is substantially repeated, except as provided otherwise hereinafter. A mixture is initially formed by combining 70 parts of polydimethylsiloxane (LS4340-103) per 100 parts of the mixture prepared in Comparative Example D (the polydimethylsiloxane and AL600 alumina powder) by hand mixing and compounding in the three roll mill. The mixture is combined with 0.25 parts of Catalyst 50 per 100 parts of mixture before degassing, then the resulting mixture is injection molded and cured substantially as described in Comparative Example A to obtain a slab. The slab is post cured, sampled, and tested substantially as described in Comparative Example A. The data for the slab prepared according to Example 3 is shown in Table I.

TABLE I

Examples 1–3 and Comparative Examples A–D - Slab Sample Data

| Example | Total Filler[1] Content (vol %) | Alumina Filler Content (vol %) | Durometer hardness[2] (Shore A) | Mean Filler Size: (μm) | Particle Size (μm) Larger than 95% of the number of particles | 99% of the number of particles | 95 weight percent of particles | Wear Rate (mils/100 cycles) |
|---|---|---|---|---|---|---|---|---|
| 1 | 16.5 | 14 | 43 | 24.7 | 51 | 73 | 116 | 0.81 |
| 2 | 25.1 | 22.4 | 52 | 12.5 | 22.8 | 28 | 36.7 | 1.07 |
| 3 | 17.2 | 14 | 52 | 1.69 | 3.4 | 4.15 | 5.0 | 1.17 |
| A | 38.5 | 36.2 | 72 | 24.7 | 51 | 73 | 116 | 2.04 |
| B | 37.5 | 35 | 71 | 12.5 | 22.8 | 28 | 36.7 | 2.08 |
| C | 39.7 | 37.3 | 62 | 81.3 | 152 | 200 | 300 | 0.87 |
| D | 37.4 | 35 | 66 | 1.69 | 3.4 | 4.15 | 5.0 | 2.17 |

[1]Total Filler includes alumina, iron oxide, silica, and trace oxides. In Examples 1–3 and Comparative Examples A–D, the silica content is less than 1 vol %, based on total volume of the slab. All volume percentages are based on total volume of the slab.
[2]Measured at 25° C.

Table I illustrates that the polydimethylsiloxane formulations with relatively low amounts of filler provide significantly improved wear resistance compared with formulations having higher levels of filler. Compare, for example, Example 1 vs. Comparative Example A and Example 2 vs. Comparative Example B. If the filler (alumina) particle size is very large, such as a Comparative Example C, then the wear rates are good, but the surface layer is also too rough to provide a good quality fused image. If the filler (alumina) particle sizes are relatively small and a relatively low amount of filler is employed, such as in Example 3, then the wear rate is somewhat higher, but still improved over use of the filler at a relatively high loading. For example, compare the wear rates of Example 3 and Comparative Example D.

COMPARATIVE EXAMPLE E

A commercial polydimethylsiloxane mixture (EC4952) believed to comprise polydimethylsiloxane, with alumina, iron oxide, and silica fillers in the amounts listed in Table II, is blended with Cat 50 catalyst at 400 parts of the EC4952 mixture to 1 part catalyst. The blend is degassed under high vacuum for about 5 minutes, then the mixture is poured into a 70 mil slab mold. The mold is cured at 60° C. for 18 hours and de-molded. The free slabs are post cured at 205° C. for 4 hours prior to use. A 0.59 inch wide strip is cut from the slab for surface abrasion testing. Surface abrasion (wear rate) is performed using a Norman abrader apparatus substantially as described in Comparative Example A. Durometer hardness is also determined substantially as in Comparative Example A. The data is given in Table II.

EXAMPLE 4

The procedure of Comparative Example E is substantially repeated, except as provided otherwise hereinafter. A 100 part sample of the EC4952 mixture is blended with 15 parts of polydimethylsiloxane (LS4340-103). This blend is then combined with Cat 50 catalyst at 295 parts of the blend to 1 part of catalyst, and then degassed under high vacuum. The slab is cured, sampled, and tested substantially as described in Comparative Example E. Relative to Comparative Example E, the slab obtained by Example 4 has a lower filler content (vol %) and lower Shore A durometer hardness, and also a significantly lower wear rate. The data is given in Table II.

EXAMPLE 5

The procedure of Example 4 is substantially repeated, except as otherwise provided hereinafter. A 100 parts sample of the EC4952 mixture is blended with 27 parts of the polydimethylsiloxane (LS4340-103). The blend is then combined with Cat 50 catalyst at 254 parts of the blend to 1 part catalyst. All other procedures are substantially the same. The resulting slab has a lower amount of filler (vol %) and also a lower Shore A durometer hardness relative to the slab obtained by Example 4. The data is given in Table II.

TABLE II

Examples 4–5 and Comparative Example E - Slab Sample Data

| Example No. | Total Filler[1] Content (vol %) | $Al_2O_3$ Filler Content (vol %) | $Fe_2O_3$ Filler Content (vol %) | $SiO_2$ Filler Content (vol %) | Durometer hardness[2] (Shore A) | Wear Rate (mils/100 cycles) |
|---|---|---|---|---|---|---|
| E | 41.5 | 39.6 | 1.4 | 0.5 | 68 | 1.28 |
| 4 | 32.4 | 30.2 | 1.6 | 0.6 | 50 | 0.82 |
| 5 | 27.8 | 25.4 | 1.7 | 0.7 | 45 | 0.71 |

[1]Total Filler includes alumina, iron oxide, silica, and trace oxides. Volume percents are based on total volume of the slab.
[2]Measured at 25° C.

EXAMPLE 6

A cylindrical, tubular, aluminum fuser core is cleaned and dried. The core is then primed with a uniform coat of DOW™ 1200 RTV Prime Coat primer. Silastic™-J silicone rubber is then mixed (it comes as both a base and cure agent from the manufacturer), injection molded onto the core, and cured at an elevated temperature of at least 40° C. for a time sufficient to provide sufficient green strength so that the roller can be demolded without damage thereto. The roller is then removed from the mold and baked in an oven at an elevated temperature to substantially complete the reaction. After air cooling, the roller has a base cushion layer of the cured Silastic™-J material which is approximately 180 mils (0.180 inches) thick. The durometer hardness of the base cushion layer (measured as a slab) is determined, according to the procedure described in Comparative Example A, and is measured as a Shore A hardness of 63. Thereafter, 100 parts of a commercial polydimethylsiloxane formulation (EC4952) with filler material therein is blended with 27 parts of polydimethylsiloxane (LS4340-103) and 0.5 parts of Catalyst 50. The blended mixture is degassed and then blade coated directly onto the Silastic™-J silicone rubber layer and oven cured to form a second layer (a fusing surface layer) of polydimethylsiloxane over the base cushion layer. From the results of Example 5 above, the surface layer (measured as a slab) has a Shore A hardness of 45. The cured roller is then ground to provide a cushion (base cushion layer and surface layer combined) with a final thickness of about 200 mils (0.200 inches).

The finished roller is measured to determine its apparent (combined) hardness by substantially following the procedure of ASTM D2240, except as otherwise provided hereinafter. As with measurement of hardness for a slab, previously described herein, the gauge is mounted on the test stand, but the stand also includes a holder for the roller which consists of a 4 inch long "V"-shaped block that can hold the roller steady within the "V" section thereof and also allow for centering of the roller sample under the indenter tip of the hardness gauge. The gauge is aligned such that the foot of the gauge is parallel to the roller axis and tangent to the circumference of the roller. A hardness reading is made by taking the maximum reading from the gauge dial within 1 second after the force is applied and gauge comes into contact with the sample. Five such readings are taken in separate locations around the circumference of the cylindrical roller and the mean is calculated from such readings for each roller. The Shore A hardness reported is the mean value taken from the readings, and it is measured at room temperature, i.e., 25° C.

For Example 6, the apparent hardness of the roller is determined to be a Shore A of 61.

MACHINE TEST EXAMPLE 7 AND COMPARATIVE EXAMPLE F

Comparative Example F is a performance test in an electrophotographic process of a fuser roller commercially used in a Digimaster™ 9110 electrostatographic printer manufactured by Heidelberg Digital L.L.C., Rochester, N.Y. Example 7 is also a performance test in an electrophotographic process of the fuser roller prepared by Example 6 above, which is then compared to the performance of the roller of Comparative Example F.

A commercially available Imagesource™ 110 printer/copier (also made by Heidelberg Digital) is used to test the performance of both rollers, and the machine components thereof are unchanged, except for the following: the process is accelerated to 150 prints per minute, the toner is a polyester toner, and the fuser oil employed in a run is changed to that as described in Table III below.

The standard fuser oil for the Imagesource™ 110 machine, is a 60,000 centistoke ("cSt") silicone oil. In addition to this standard oil, a "thiol" fluid is also used which is a blend of the standard oil with 12.5 weight percent, based on total weight of the blend, of a mercaptopropyl functional polydimethylsiloxane having a viscosity of 7880 cp and a thiol content of 0.087 wt %. Additionally, the fuser setpoint temperature is varied between a high (365° F.) and a low (335° F.) temperature setpoint.

Toner offset from the paper sheets employed is removed from the fuser roller by the external heater rollers used in the machine, by virtue of the relatively high surface energy of the anodized aluminum surface of the heater rollers. A thin NOMEX® polyamide web is used to remove toner offset from the heater rollers by contact with both, which web is oriented similar to the apparatus shown in FIG. 2 herein. The density of the toner offset collected by the cleaning web estimates the offset rate of the fuser. As discussed hereinabove, this offset acts as contamination, and accordingly the offset rate indicates the degree of contamination of the machine.

In order to measure fuser offset collected on the fuser heater roller cleaning web, a test is run for 2,500 prints of a multiple density image. An X-Rite 310 Transmission Densitometer, from X-Rite Company, Grand Rapids, Mich. is used to measure the optical transmission density of the offset on the heater roller cleaning web.

The values obtained from these tests are set forth in Table III. A higher web transmission density indicates an increased fuser offset rate, and thusly a greater degree of contamination. As discussed herein, poor contamination levels indicate toner offset on electrostatographic apparatus parts and on images, and possibly reduced fuser roller life.

Clean webs are initially used to set, i.e., calibrate, the measure optical transmission density to a zero point. In general, with respect to contamination, cleaning web transmission densities below 0.3 are excellent, at 0.31 to 0.5 are very good, at 0.51 to 0.79 are good, and at 0.8 and above could lead to unacceptable levels of contamination.

TABLE III

Toner Offset to Cleaning Web

| Fuser roller | Oil Used | Transmission Density @ High temp Setpoint | Transmission Density @ Low temp Setpoint | Average Transmission Density |
|---|---|---|---|---|
| Comparative Example F | Standard | 0.56 | 1.50 | 1.03 |
| Comparative Example F | Thiol | 0.31 | 1.50 | 0.90 |

TABLE III-continued

| Toner Offset to Cleaning Web | | | | |
|---|---|---|---|---|
| Fuser roller | Oil Used | Transmission Density @ High temp Setpoint | Transmission Density @ Low temp Setpoint | Average Transmission Density |
| Example 7 | Standard | 0.35 | 0.75 | 0.55 |
| Example 7 | Thiol | 0.13 | 0.47 | 0.3 |

Table III demonstrates that a fuser member according to the invention (Example 7) performs better in an electrophotographic process as seen in the significantly lower toner contamination, with both types of fuser oils, in comparison to the fuser roller of Comparative Example F. The data also show that the fuser member of the invention can display very low levels of toner offset, even at relatively high machine speeds such as 150 pages/minute.

EXAMPLE 8

A fuser roller is prepared by substantially following the procedure of Example 6, except as provided otherwise hereinafter. Initially, the fuser core is coated with a base cushion substantially as described in Example 6. The base cushion is then preheated before coating it with a second layer, i.e., a fusing surface layer, which is comprised of polydimethylsiloxane. The polydimethylsiloxane layer is prepared from a well blended mixture of 846.7 grams of the EC4952 silicone rubber previously mentioned herein, together with 3.8 g of Cat 50 catalyst and 228.8 grams of the LS4340-103 polydimethylsiloxane also as previously mentioned. The mixture is degassed under vacuum for a sufficient length of time to remove air bubbles, and a sufficient quantity of the mixture is then coated by well known blade coating methods onto the preheated base cushion layer of the fuser core. The so-coated rollers are allowed to cure at room temperature until curing of the polydimethylsiloxane reaches a point where gelation occurs. The rollers are then placed into a curing oven for post-curing at an elevated temperature (to and including a temperature above the anticipated fusing temperature for the roller) for a time sufficient to substantially complete the reaction. After cooling the roller to room temperature, the roller is ground to provide a cushion (base cushion layer and fusing surface layer) having a thickness and shape, i.e., profile, which are substantially the same as the standard fuser supplied with the Digimaster™ 9110 printer. The volume percent filler for the fusing surface layer, in terms of total volume of the surface layer, and materials employed in the fusing surface layer coating mixture are listed in Table IV, while durometer apparent hardness is listed in Table V. The apparent hardness is measured substantially as described in Example 6 and listed in Table V. The durometer hardness for the base cushion layer and surface layer, measured in a slab form substantially as described in Comparative Example A, are also listed in Table V for comparison with the apparent hardness value.

EXAMPLE 9

The procedure of Example 8 is substantially repeated, except as provided otherwise hereinafter. A fuser roller is prepared similarly to Example 8, but the surface layer is prepared from a mixture which is blended from 798.9 grams of the EC4952 polydimethylsiloxane formulation, 2.4 grams of Cat 50 catalyst, and 151.8 grams of the LS4340-103 polydimethylsiloxane mixture. Data for the example similarly appears in Tables IV and V.

EXAMPLE 10

A 0.25 inch thick rectangular slab sample is prepared from substantially the same silicone mixture used to form the fusing surface layer of Example 9. A portion of the degassed mixture is poured into an aluminum mold measuring approximately 4 inches×4inches×0.25 inches, which is then placed into an oven at about 70° C. for about two hours. The mold is removed from the oven and cooled to room temperature. After disassembly of the mold, the rubber slab sample is removed therefrom and post-cured substantially as described in Example 8. The durometer hardness of the slab is measured substantially as described in Comparative Example A and is listed in Table V for comparison purposes.

EXAMPLE 11

The procedure of Example 8 is substantially repeated, except as provided otherwise hereinafter. A fuser roller is prepared similarly to Example 8, but the surface layer is prepared from a mixture which is blended from 559.2 grams of the EC4952 mixture, 2.5 grams of Cat 50 catalyst, and 391.2 grams of the LS4340-103 polydimethylsiloxane mixture. Data for the example similarly appears in Tables IV and V.

EXAMPLE 12

The procedure of Example 10 is substantially repeated, except as provided otherwise herienafter. A 0.25 inch thick rectangular slab sample is prepared from substantially the same mixture used for the fusing surface layer of Example 11. The durometer hardness is listed in Table V.

COMPARATIVE EXAMPLE G

The procedure of Example 8 is substantially repeated to produce a fuser roller, except that the base cushion layer is coated with a mixture of 200 grams of the EC-4952 mixture previously mentioned and 0.8 grams of Cat 50 catalyst.

COMPARATIVE EXAMPLE H

A 0.25 inch thick rectangular slab is prepared from substantially the same mixture used for the fusing surface layer of Comparative Example G by casting and preparing the slab substantially according to the procedure described in Example 10. The durometer hardness of the slab is determined substantially according to the procedure described in Comparative Example A.

TABLE IV

| Comparative Examples G–H and Examples 8–12 - Coating Formulations | | | | |
|---|---|---|---|---|
| Example No. | Total Filler Content (vol %) | Weight of Materials in Coating Mixture (grams) | | |
| | | EC-4952 | LS 4340-103 | Cat-50 |
| G | 41.7 | 200 | 0 | 0.8 |
| H | 41.7 | 200 | 0 | 0.8 |
| 8 | 28.0 | 846.7 | 228.8 | 3.8 |
| 9 | 31.0 | 798.9 | 151.8 | 2.4 |
| 10 | 31.0 | 798.9 | 151.8 | 2.4 |
| 11 | 18.9 | 559.2 | 391.2 | 2.5 |
| 12 | 18.9 | 559.2 | 391.2 | 2.5 |

TABLE V

| Comparative Examples G–H & Examples 8–12 - Roller/Cushion Layer Hardness Data | | | | |
|---|---|---|---|---|
| Example No. | Surface Layer Total Filler Content (vol %) | Roller Apparent Hardness[1] (Shore A) | Roller Base Cushion Layer Hardness[1,2] (Shore A) | Roller Fusing Surface Layer Hardness[1,3] (Shore A) |
| G | 41.7 | 64 | 63 | 66 |
| 8 | 28.0 | 63 | 63 | 46 |
| 9 | 31.0 | 63 | 63 | 46 |
| 11 | 18.9 | 60 | 63 | 37 |

[1]Durometer hardness measured at 25° C.
[2]Base cushion layer hardness is measured with the material (cured Silastic ™ -J) in slab form. See, Example 6.
[3]Fusing surface layer hardness for Comparative Example G, and Examples 8, 9, and 11 are taken from the durometer hardness values determined for slabs of the respective materials employed therein; for example, the fusing surface layer hardness for Examples 9 and 11 is taken from the slabs of Examples 10 and 12 respectively and the hardness value for the fusing surface of Comparative Example G is taken from the slab of Comparative Example H.

As can be seen in Table V, the data shows that reduced filler content in the fusing surface layer provides a corresponding reduction in the durometer hardness of such layer. However, when such layer is formed over a base cushion layer, such as the silicone rubber (Silastic™-J material) having a higher durometer hardness, the resulting roller will have a composite, i.e., apparent, hardness close to that of the base cushion layer. The result is a fuser roller which has similar performance to that of the base cushion material, but improved toner offset and wear due to the reduced hardness of the fusing surface layer.

MACHINE TESTING OF COMPARATIVE EXAMPLE G and EXAMPLE 8

Fuser rollers prepared in Comparative Example G and Example 8 (each having a length of 15.5 inches) are performance tested in the above-described Digimaster™ 9110 printer, running standard toner, fuser oil, and heater roller cleaning web. The process is accelerated however to 150 prints per minute and the fuser roller setpoint temperature is increased from 355° F. to 365° F. Test paper employed is 8–½"×11" grain-long 20 lb bond paper. A combination of text and solid area image patches are run in duplex (perfected) mode, counting each side of a sheet as an image in the total image count for roller life purposes.

Throughout the machine test, the fuser roller shape and size is periodically monitored by removing it from the test machine, letting it cool to room temperature, and measuring its diameter in a number of zones. This inspection is done with a non-contact gauging system, measuring the roller diameter in a number of zones axially along the roller to provide a piecewise-continuous profile of the roller. It is recognized in the art that the most severe wear from running in a machine tends to occur in the center of the roller lengthwise, so a parameter called "center wear" will be used herein to evaluate the roller shape. This parameter is related to roller shape rather than roller absolute diameter, since paper handling performance is generally driven by the relative diameter differences along the roller, and is independent of overall roller shrinkage changes. Therefore, "center wear," is defined to be the difference between the smallest diameter (D_min) at any location in the center zone 6–9 inches from a reference end of the roller, minus the average of the diameters at two (2) inches to either side of the smallest location, called D_left an D_right. This is shown in algebraic form in Equation 1 below:

$$\text{"center wear"}=D_\text{min}-0.5*(D_\text{left}+D_\text{right}) \quad \text{[Equation 1]}$$

A convenient reference point for measurement of center wear during the life of a fuser roller is after 600,000 images have been fused by the roller.

The rollers from Comparative Example G and Example 8 are each used to fuse 600,000 images in the Digimaster™ 9110 printer. The roller center wear parameter is measured after running the 600,000 prints, and the results are summarized in Table VI below. As can be seen, the roller prepared in Example 8 shows significantly improved wear resistance relative to the fuser roller prepared in Comparative Example G with a conventional EC-4952 silicone rubber.

TABLE VI

| Fuser Roller Center Wear at Life of 600,000 Images - Comparative Example G and Example 8 | |
|---|---|
| Example No. | Center Wear at 600 K images (in) |
| G | 0.0034 |
| 8 | 0.0010 |

Suitable toners for use with the present invention include styrene-based toners such as styrene-butylacrylate toners, and polyester-based toners. In addition to polymer binder, toners further include suitable additives selected from pigments, charge control agents, surface treatments, magnetic addenda, waxes, and other release aids. Preferred toners include those having a viscosity of from at least about 5,000 poise to about 1,000,000 poise at a temperature of about 120° C., or similar temperatures representative of the toner temperature during fusing.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

Although coloring is optional, normally a colorant is included and can be any of the materials mentioned in Colour Index, Volumes I and II, Second Edition, incorporated herein by reference.

A very wide variety of optional charge control agents for positive and negative charging toners are available and can be used in the toners of the present invention. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxa midato(2-)], ammonium, sodium, and hydrogen (Organoiron available from Hodogaya Chemical Company Ltd.).

The surface treatment may be a silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 $\mu$m in diameter (more preferably about 0.1 $\mu$m), such as acrylic polymers, silicone-based polymers, styrenic polymers, fluoropolymers, copolymers thereof, and mixtures thereof.

The magnetic toner particles of the present invention contain at least one type of magnetic additive or material, such as soft iron oxide (Fe3O4) which is dispersed in the toner or ink and thus makes the toner or ink ferro-magnetic. The magnetic materials included in the monocomponent toner of the present invention are generally of the soft type magnetic materials conventionally used in toners. Examples of useful magnetic materials include mixed oxides of iron, iron silicon alloys, iron aluminum, iron aluminum silicon, nickel iron molybdenum, chromium iron, iron nickel copper, iron cobalt, oxides of iron and magnetite. Other suitable magnetic materials that can be present in the toner include, but are not limited to, magnetic material containing acicular magnetites, cubical magnetites, and polyhedral magnetites. A useful soft iron oxide is TMB1120 from Magnox Inc.

Useful release agents include low molecular weight polypropylene, natural waxes, low molecular weight synthetic polymer waxes, commonly accepted release agents, such as stearic acid and salts thereof, and others. Examples of suitable waxes include, but are not limited to, polyolefin waxes, such as low molecular weight polyethylene, polypropylene, copolymers thereof and mixtures thereof.

The invention has been described in detail with particular reference to certain preferred embodiments thereof, but it is to be understood that variations and modifications can be effected within the spirit and scope of the invention.

We claim:

1. A fuser member comprising a core and a pliant coating on the core, the coating comprising a base cushion layer comprised of a first elastomeric composition and a surface layer comprised of a second elastomeric composition disposed over the base cushion layer, wherein said base cushion layer is comprised of a first polyorganosiloxane composition having a durometer hardness at 25° C. of from about 35 to about 80 Shore A and a surface layer is comprised of a second polyorganosiloxane composition having a durometer hardness at 25° C. of from about 20 to about 55 Shore A, further provided that the hardness of the surface layer is less than the hardness of the base cushion layer.

2. The fuser member of claim 1 wherein at least one of said first polyorganosiloxane composition and said second polyorganosiloxane composition is a polydimethylsiloxane.

3. The fuser member of claim 1 wherein the base cushion layer has a thickness of from about 77 to about 500 mils.

4. The fuser member of claim 3 wherein the surface layer has a thickness of from about 3 to about 100 mils.

5. The fuser member of claim 1 wherein the surface layer further comprises a particulate silica filler in an amount of about 10 volume percent or less, based on total volume of the surface layer.

6. The fuser member of claim 5 wherein the particulate silica filler in present in an amount of about 5 volume percent or less, based on total volume of the fusing surface layer.

7. The fuser member of claim 6 wherein the particulate silica filler in present in an amount of about 2 volume percent or less, based on total volume of the fusing surface layer.

8. The fuser member of claim 5 wherein the surface layer further comprises at least one second particulate filler having a thermal conductivity of greater than about 5 BTU/(hr ft ° F).

9. The fuser member of claim 8 wherein the second particulate filler is at least one metal oxide.

10. The fuser member of claim 9 wherein the at least one metal oxide is selected from cupric oxide, aluminum oxide, tin oxide, iron oxide, or mixtures thereof.

11. The fuser member of claim 8 wherein the surface layer comprises from about 5 to about 35 volume percent of the second particulate filler based on total volume of the surface layer.

12. The fuser member of claim 8 wherein from about 15 to 35 volume percent of the second particulate filler, based on total volume of the second particulate filler, is comprised of particles having a diameter greater than 8 microns.

13. The fuser member of claim 8 wherein from about 10 to about 25 volume percent of the second particulate filler, based on total volume of the second particulate filler, is comprised of particles having a diameter greater than 12 microns.

14. The fuser member of claim 8 wherein from about 5 to 15 volume percent of the second particulate filler, based on total volume of the second particulate filler, is comprised of particles having a diameter of greater than 20 microns.

15. The fuser member of claim 1 wherein the coating has an apparent hardness of from about 40 to about 75 Shore A.

16. The fuser member of claim 1 wherein the second elastomeric composition is a polyorganosiloxane and the surface layer comprises greater than 60 volume percent of the polyorganosiloxane, based on total volume of the surface layer.

17. A fuser member comprising a core and a pliant coating on the core, the coating comprising a surface layer comprised of a first elastomer and a particulate silica filler in an amount of about 10 volume percent or less, based on total volume of the surface layer, the surface layer having a durometer hardness at 25° C. of from about 20 to about 55 Shore A and a base cushion layer comprised of a second polyorganosiloxane.

18. The fuser member of claim 17 wherein the first elastomer is a polyorganosiloxane.

19. The fuser member of claim 18 wherein the polyorganosiloxane is a polydimethylsiloxane.

20. The fuser member of claim 18 wherein the surface layer comprises greater than 60 volume percent of the polyorganosiloxane, based on total volume of the surface layer.

21. The fuser member of claim 17 wherein the surface layer has a thickness of from about 3 to about 100 mils.

22. The fuser member of claim 17 wherein the surface layer further comprises a second particulate filler having a thermal conductivity of greater than about 5 Btu/(hr ft F°).

23. The fuser member of claim 22 wherein the second particulate filler is at least one metal oxide.

24. The fuser member of claim 23 wherein the at least one metal oxide is selected from cupric oxide, aluminum oxide, tin oxide, iron oxide, or mixtures thereof.

25. The fuser member of claim 22 wherein the surface layer comprises from about 5 to about 35 volume percent of the second particulate filler based on total volume of the surface layer.

26. The fuser member of claim 22 wherein from about 15 to 35 volume percent of the second particulate filler, based on total volume of the second particulate filler, is comprised of particles having a diameter greater than 8 microns.

27. The fuser member of claim 22 wherein from about 10 to about 25 volume percent of the second particulate filler, based on total volume of the second particulate filler, is comprised of particles having a diameter greater than 12 microns.

28. The fuser member of claim 22 wherein from about 5 to 15 volume percent of the second particulate filler, based on total volume of the second particulate filler, is comprised of particles having a diameter of greater than 20 microns.

29. The fuser member of claim 17 wherein the second polyorganosiloxane is a polydimethylsiloxane.

30. The fuser member of claim 17 wherein the base cushion layer has a durometer hardness at 25° C. of from about 35 to about 80 Shore A.

31. The fuser member of claim 30 wherein the hardness of the surface layer is equal to or less than the hardness of the base cushion layer.

32. The fuser member of claim 31 wherein the hardness of the surface layer is less than the hardness of the base cushion layer.

33. A fusing apparatus for fusing toner images to a receiver medium, the apparatus comprising:

a fuser member comprising a core and a pliant coating on the core, the coating comprising a base cushion layer comprised of a first elastomeric composition and a surface layer comprised of a second elastomeric composition disposed over the base cushion layer, wherein said base cushion layer is comprised of a first polyorganosiloxane composition having a durometer hardness at 25° C. of from about 35 to about 80 Shore A and a surface layer is comprised of a second polyorganosiloxane composition having a durometer hardness at 25° C. of from about 20 to about 55 Shore A, further provided that the hardness of the surface layer is less than the hardness of the base cushion layer;

a pressure member having a contact surface and positioned adjacent to the fuser member thereby forming a fusing nip there between to receive the receiver medium;

at least one external heater member positioned adjacent to and in contact with the fuser member and external thereto such that heat energy may be transferred to the fuser member by such contact; and a heat source for transferring heat energy to the at least one heater member.

34. The fusing apparatus of claim 33, wherein the particulate silica filler is present in an amount of about 5 volume percent or less, based on total volume of the surface layer.

35. The fusing apparatus of claim 33, wherein the particulate silica filler is present in an amount of about 2 volume percent or less, based on total volume of the surface layer.

36. An electrophotographic method for producing fused toner images on a receiver medium comprising the steps of:

forming an electrostatic image pattern on an image forming member;

developing the image pattern on the image forming member with fusible toner particles thereby forming a toner image thereon;

transferring the toner image to the receiver medium;

heating at least one external heater member having a contact surface thereon;

contacting the contact surface of the at least one external heater member with a fuser member comprising a core and a pliant coating on the core, the coating comprising a base cushion layer comprised of a first elastomeric composition and a surface layer comprised of a second elastomeric composition disposed over the base cushion layer, wherein said base cushion layer is comprised of a first polyorganosiloxane composition having a durometer hardness at 25° C. of from about 35 to about 80 Shore A and a surface layer is comprised of a second polyorganosiloxane composition having a durometer hardness at 25° C. of from about 20 to about 55 Shore A, further provided that the hardness of the surface layer is less than the hardness of the base cushion layer, the contact surface of the at least one external heater member being positioned adjacent to and in contact with the surface layer of the fuser member such that a contact nip is formed therebetween and heat is transferred to the fuser member from the at least one external heater member through the contact nip; and feeding the receiver medium bearing the toner image thereon into a fusing nip formed between the surface layer of the fuser member and a contact surface of a pressure member positioned adjacent to and in contact with the fuser member so as to form the fusing nip therebetween, the toner image being fused to the receiver medium by application of heat energy while the receiver medium is passed through the fusing nip.

37. The electrophotographic method of claim 36 wherein the surface layer further comprises a particulate silica filler in an amount of about 10 volume percent or less, based on total volume of the surface layer, further wherein the surface layer has a durometer hardness at 25° C. of from about 20 to about 55 Shore A.

38. The electrophotographic method of claim 37 wherein the base cushion layer is comprised of a first polyorganosiloxane composition having a durometer hardness at 25° C. of from about 35 to about 80 Shore A and the surface layer is comprised of a second polyorganosiloxane composition.

39. The method of claim 37 wherein the surface layer further comprises a second particulate filler having a thermal conductivity of greater than about 5 Btu/(hr ft F°).

40. The method of claim 39 wherein the second particulate filler is at least one metal oxide selected from cupric oxide, aluminum oxide, tin oxide, iron oxide, or mixtures thereof.

41. The method of claim 39 wherein the surface layer comprises from about 5 to about 35 volume percent of the second particulate filler based on total volume of the surface layer.

42. The method of claim 39 wherein from about 15 to 35 volume percent of the second particulate filler, based on total volume of the second particulate filler, is comprised of particles having a diameter greater than 8 microns.

43. The method of claim 39 wherein from about 10 to about 25 volume percent of the second particulate filler, based on total volume of the second particulate filler, is comprised of particles having a diameter greater than 12 microns.

44. The method of claim 39 wherein from about 5 to 15 volume percent of the second particulate filler, based on total volume of the second particulate filler, is comprised of particles having a diameter of greater than 20 microns.

45. The method of claim 38 wherein the surface layer comprises greater than 60 volume percent of the second polyorganosiloxane, based on total volume of the surface layer.

46. The method of claim 36 wherein at least 50% of the heat energy necessary to fuse the toner image to the receiver medium is transferred to the fuser member by the at least one external heater member.

47. The method of claim 36 wherein a plurality of receiver media are fed to the fusing nip at a rate of at least about 100 receiver media per minute.

48. The method of claim 47 wherein a plurality of receiver media are fed to the fusing nip at a rate of at least 140 receiver media per minute.

49. The method of claim 36 wherein the fuser member is a roller and the core is hollow and cylindrical.

50. The method of claim 49 further comprising heating the fuser member by use of an internal heat source placed inside of the core.

51. The method of claim 36 wherein the surface layer has a thickness of from about 3 to about 100 mils.

52. The method of claim 36 wherein the coating has an apparent hardness of from about 40 to about 75 Shore A.

53. The method of claim 36 further comprising applying a polyorganosiloxane release fluid having a viscosity of greater than about 1,000 cSt at 25° C. to the fuser member.

* * * * *